US008457511B2

(12) United States Patent
Chiba

(10) Patent No.: US 8,457,511 B2
(45) Date of Patent: Jun. 4, 2013

(54) IMAGE FORMING METHOD AND IMAGE FORMING DEVICE

(75) Inventor: Satoshi Chiba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 361 days.

(21) Appl. No.: 12/898,057

(22) Filed: Oct. 5, 2010

(65) Prior Publication Data

US 2011/0110680 A1 May 12, 2011

(30) Foreign Application Priority Data

Nov. 12, 2009 (JP) ..... 2009-259123

(51) Int. Cl.
*G03G 15/16* (2006.01)

(52) U.S. Cl.
USPC ..... 399/66; 399/101; 399/304

(58) Field of Classification Search
USPC ..... 399/66, 101, 302–304, 313
See application file for complete search history.

(56) References Cited

U.S. PATENT DOCUMENTS

| | | | | |
|---|---|---|---|---|
| 5,745,829 | A * | 4/1998 | Gazit et al. | 399/302 |
| 6,163,676 | A | 12/2000 | Levanon et al. | |
| 8,023,849 | B2 * | 9/2011 | Kamijo | 399/66 |
| 8,145,107 | B2 * | 3/2012 | Tanaka et al. | 399/304 |
| 8,254,818 | B2 * | 8/2012 | Chiba et al. | 399/304 |

FOREIGN PATENT DOCUMENTS

| | | |
|---|---|---|
| JP | 2000-508280 T | 7/2000 |
| WO | WO-97/09262 A1 | 3/1997 |

* cited by examiner

*Primary Examiner* — William J Royer
(74) *Attorney, Agent, or Firm* — Global IP Counselors, LLP

(57) ABSTRACT

An image forming method includes transferring images carried by an image carrier to a transfer material by a transfer roller coming in contact with the image carrier via the transfer material, the transfer roller having a concaved portion in its circumferential surface and contacting with or being separated from the image carrier due to its rotation, separating the transfer roller from the image carrier by the rotation of the transfer roller after transferring the images to the transfer material, stopping the transfer roller in a state where the transfer roller is separated from the image carrier, and moving the image carrier and cleaning the image carrier using a cleaning member while the transfer roller is stopped.

7 Claims, 18 Drawing Sheets

POSITION CORRECTION PROCESSING SEQUENCE FOR SECONDARY TRANSFER ROLLER

CLEANING AND PRINTING START SEQUENCE

IMAGE FORMING METHOD AND IMAGE FORMING DEVICE

BACKGROUND

1. Technical Field

The present invention relates to an image forming method and an image forming device, which form images by transferring toner images developed by a development device to a transfer material such as a recording paper and fixing the toner images on the transfer material.

2. Related Art

There have been proposed a large number of wet type image forming devices which develop latent images by using a liquid developer with a high viscosity in which toners of a solid component are dispersed in a liquid solvent, and allow electrostatic latent images to be visualized. Developers usable in the wet type image forming devices are formed by suspending solid contents (toner particles) in an organic solvent (carrier liquid) with a high viscosity which is constituted by a silicon oil, a mineral oil, an edible oil, or the like and has an electrical insulation property, and the toner particle has a particle diameter of about 1 μm and is extremely fine. The wet type image forming devices which employ the fine toner particles enable a higher image quality than dry type image forming devices which employ powder toner particles with a particle diameter of about 7 μm.

As disclosed in, for example, JP-T-2000-508280, in an image forming device employing such a liquid developer, an electrostatic latent image is formed on a drum having a photoconduction surface by using an image device such as a laser scanner or the like, the electrostatic latent image is developed by a liquid toner containing charged toner particles and a carrier liquid, and a developed image is printed onto a base material.

In the image forming device, the base material is passed through a transfer portion constituted by a middle transfer member and a pressing roller, and the developed image is formed by transferring an image on the middle transfer member to the base material. Particularly, a gripper is mounted on the pressing roller to grip a front end portion of the base material forwarded to the pressing roller, and after the image on the middle transfer member is transferred thereto, the base material is released. This determines a position of the image transferred to the base material.

As described above, in the image forming device disclosed in JP-T-2000-508280, the position of the base material is determined by the gripper mounted on the pressing roller, but, as can be seen from FIG. 1, FIG. 2A, and the like in JP-T-2000-508280, the gripper is provided on a surface layer of the pressing roller, and is considered only to use a simple and small-sized mechanism to an extent of not blocking the rotation of the middle transfer member and the pressing roller.

In addition, in the image forming device disclosed in JP-T-2000-508280, when the image forming device is stopped by a paper jam or the like, if the transfer to the base material is not performed, the liquid toners remaining on the surface of the middle transfer member need cleaning. However, in this image forming device, since the middle transfer member and the pressing roller always contact with each other, the surface of the pressing roller is contaminated by the liquid toners remaining on the surface of the middle transfer member. The contamination on the surface of the pressing roller makes a base material subsequently transported to the pressing roller dirty, and this has influence on the image quality.

SUMMARY

According to an aspect of the invention, there is provided an image forming method including transferring images carried by an image carrier to a transfer material by a transfer roller contacting with the image carrier via the transfer material, the transfer roller having a concaved portion in its circumferential surface and contacting with or being separated from the image carrier due to its rotation; separating the transfer roller from the image carrier by the rotation of the transfer roller after transferring the images to the transfer material; stopping the transfer roller in a state where the transfer roller is separated from the image carrier; and moving the image carrier and cleaning the image carrier using a cleaning member while the transfer roller is stopped.

Also, the image forming method may further include forming latent images on a latent image carrier which transfers the images to the image carrier after cleaning the image carrier; and rotating the transfer roller after beginning to form the latent images on the latent image carrier.

Here, in the image forming method, the image carrier may be an image carrier belt wound and hung on a roller, or an image carrier drum.

According to an aspect of the invention, there is provided an image forming device including an image carrier that carries images; a transfer roller that has a concaved portion in its circumferential surface and contacts with or is separated from the image carrier by its rotation; a cleaning member that cleans the image carrier; and a controller that enables the transfer roller to be stopped at a position where the transfer roller is separated from the image carrier by the rotation of the transfer roller, enables the image carrier to be moved when the transfer roller stops rotating, and enables the image carrier to be cleaned using the cleaning member.

Also, the image forming device may further include a rotation position detector that detects a rotation position of the transfer roller, wherein the controller enables the transfer roller to stop rotating based on a result detected by the rotation position detector.

In the image forming device, the cleaning member may include a cleaning roller that contacts with the image carrier and is applied with bias; and a coating member that coats liquid to the cleaning roller.

Also, the image forming device may further include a gripper that grips a transfer material in the concaved portion.

In this way, according to the image forming method and the image forming device of the embodiments of the invention, it is possible to prevent the transfer roller from being contaminated with a developer carried on the image carrier by not starting cleaning of the image carrier in the state where the image carrier and the transfer roller are in contact with each other.

In addition, regarding a cleaning member for cleaning the transfer roller, even in a case where the image carrier is cleaned in the state where the image carrier is applied with the carrier liquid, since the image carrier is cleaned in the state where the image carrier and the transfer roller are separated from each other, it is possible to prevent the transfer roller from being contaminated with the liquid developer which has been applied to the image carrier, due to the cleaning.

In addition, after the cleaning of the image carrier is completed, latent images start to be written on the latent image carrier which transfers images to the image carrier, and the transfer roller begins to rotate. Thereby, it is possible to reduce the probability of the transfer roller contacting with the image carrier before the images are transferred to the image carrier, and thus to suppress the contamination of the transfer roller.

Also, the cleaning roller is applied with a bias during cleaning the image carrier, and thereby it is possible to attract toner remaining on the transfer roller toward the cleaning roller and perform efficient recovery of the toner. An absolute value of the bias during cleaning the image carrier may be set greater than that of a bias during typical printing. In this way, it is possible to improve the recovery efficiency of toner during the cleaning when the amount of toner is more than that during typical printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
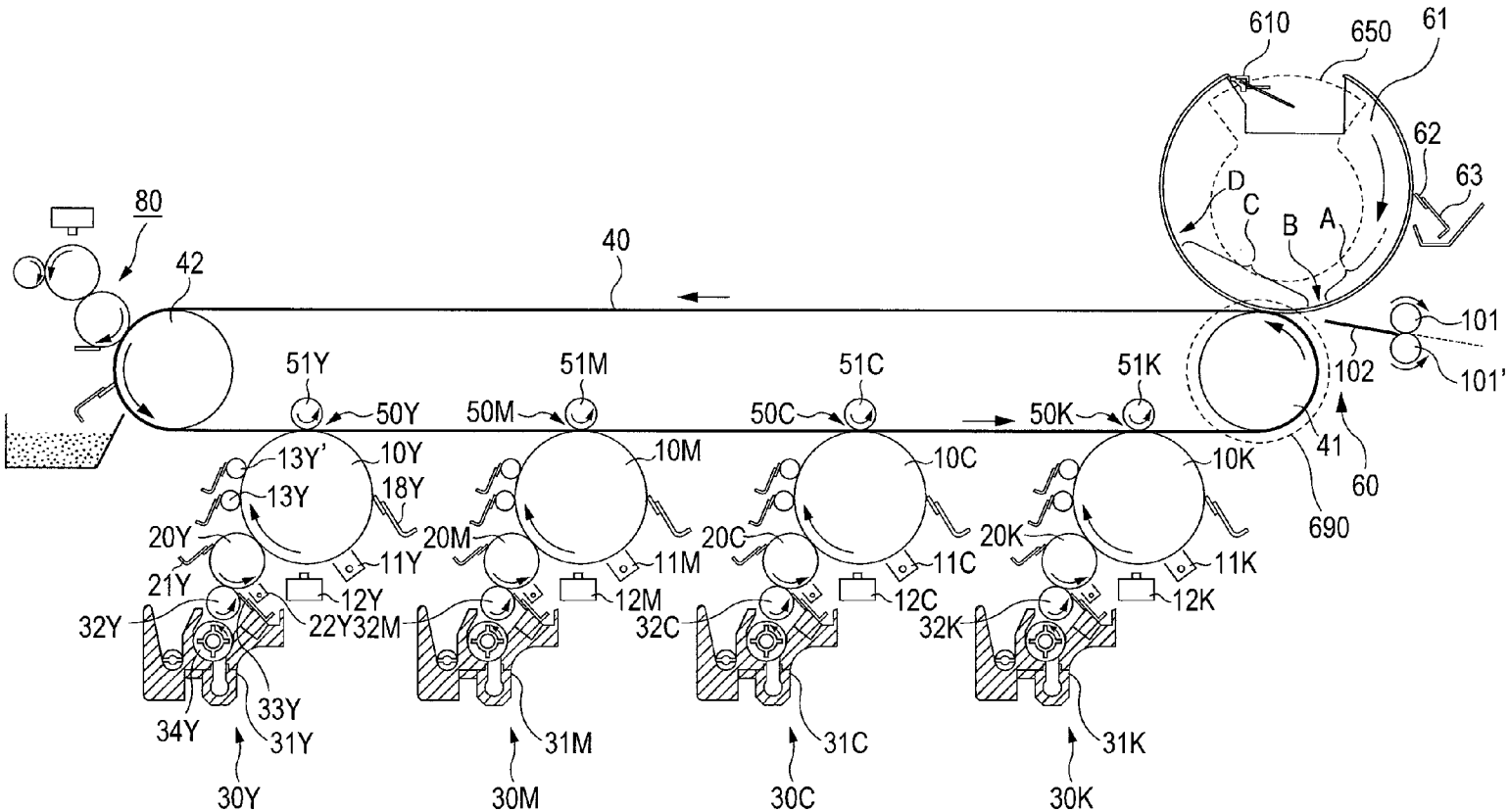
FIG. 1 is a diagram illustrating a main configuration of an image forming device.

FIG. 1 is a main configuration of an image forming device according to an embodiment of the invention. With respect to a transfer belt 40, as an image carrier or a transfer medium, which is positioned at a central portion of the image forming device, development devices 30Y, 30M, 30C and 30K as development portions are arranged in the lower side of the image forming device, and, constituent elements such as a secondary transfer unit 60 as a transfer portion, a fixing unit (not shown) and the like are arranged in the higher side of the image forming device.

Around photoconductors 10Y, 10M, 10C and 10K as latent image carriers, there are provided corona charging devices 11Y, 11M, 11C and 11K, exposure units 12Y, 12M, 12C and 12K, and the like, such as an LED array, in order to form images using toner. The corona charging devices 11Y, 11M, 11C and 11K charge the photoconductors 10Y, 10M, 10C and 10K in the same manner, an exposure is performed by the exposure units 12Y, 12M, 12C and 12K as exposure portions, based on input image signals, and electrostatic latent images are formed on the charged photoconductors 10Y, 10M, 10C and 10K.

The development devices 30Y, 30M, 30C and 30K substantially include development rollers 20Y, 20M, 20C and 20K which are developer carriers, developer reservoirs 31Y, 31M, 31C and 31K which store liquid developers of respective colors including yellow (Y), magenta (M), cyan (C), and black (K), and anilox rollers 32Y, 32M, 32C and 32K, as developer supply members which are coating rollers applying the liquid developers of the respective colors to the development rollers 20Y, 20M, 20C and 20K from the developer reservoirs 31Y, 31M, 31C and 31K. Thereby, the electrostatic latent images formed on the photoconductors 10Y, 10M, 10C and 10K are developed using the liquid developers of the respective colors.

Primary transfer portions 50Y, 50M, 50C and 50K transfer the images formed on the photoconductors 10Y, 10M, 10C and 10K to the transfer belt 40, via nip portions between the photoconductors 10Y, 10M, 10C and 10K and primary transfer backup rollers 51Y, 51M, 51C and 51K.

The transfer belt 40 ("image carrier belt" in an embodiment of the invention) is formed of an elastic member such as seamless rubber or the like, which hangs between a belt driving roller 41 and a tension roller 42, contacts with the primary transfer portions 50Y, 50M, 50C and 50K and the photoconductors 10Y, 10M, 10C and 10K, and is rotatably driven by the belt driving roller 41. In the primary transfer portions 50Y, 50M, 50C and 50K, the photoconductors 10Y, 10M, 10C and 10K are arranged opposite to the primary transfer backup rollers 51Y, 51M, 51C and 51K with the transfer belt 40 interposed therebetween. The developed toner images of the respective colors on the photoconductors 10Y, 10M, 10C and 10K are sequentially transferred onto the transfer belt 40 in an overlapping manner at contact positions with the photoconductors 10Y, 10M, 10C and 10K as transfer positions, thereby forming toner images of full colors.

The tension roller 42 allows the transfer belt 40 to hang thereon along with the belt driving roller 41 and the like. In a place where the transfer belt 40 hangs on the tension roller 42, a cleaning device 80 (a "cleaning member" in an embodiment of the invention) contacts therewith to clean remaining toner and carrier on the transfer belt 40.

The secondary transfer unit 60 is provided with a secondary transfer roller 61 (a "transfer roller" in an embodiment of the invention) which is a means of transferring the toner images to a transfer medium, and the like. The secondary transfer roller 61 rotates in the direction indicated by the arrow so as to be moved along the movement direction of the transfer belt 40. In addition, the secondary transfer roller 61 is applied with a transfer bias and transfers, at a transfer nip, the toner images on the transfer belt 40 to a transfer material (also referred to as a recording material) such as paper, film, fabric, or the like which is transported in a transfer material transport path L. Further, the secondary transfer unit 60 has a secondary transfer roller cleaning blade 62 which cleans the secondary transfer roller 61, a blade support member 63, and the like.

A transfer material transport device (not shown) is arranged downstream of the secondary transfer unit 60 in the transfer material transport path L and transports the transfer material to a fixing unit (not shown). The fixing unit welds the toner images of a single color or full colors, which have been transferred onto a transfer material such as paper or the like, and fixes them to the transfer material such as paper or the like.

A transfer material is supplied to the image forming device by a paper feeding device (not shown). The transfer material set in the paper feeding device is fed to the transfer material transport path L at a predetermined timing for each sheet. In the transfer material transport path L, the transfer material is transported to the secondary transfer position using gate rollers 101 and 101' as a transfer material transfer portion and a transfer material guide 102, where toner images of a single color or toner images of full colors formed on the transfer belt 40 are transferred to the transfer material.

The transfer material to which the toner images are secondarily transferred is transported to the fixing unit by the transfer material transport device, as described above. The fixing unit includes a heating roller (not shown) and a pressing roller (not shown) which is biased to the heating roller side at a predetermined pressure, and the transfer material is inserted into a nip therebetween. Thereby, the toner images of a single color or full colors transferred on the transfer material are welded and fixed to the transfer material such as paper or the like.

Here, the peripherals of the photoconductors 10Y, 10M, 10C, and 10K of the respective colors and the development devices 30Y, 30M, 30C, and 30K have the same configurations, and thus the development device will now be described by exemplifying the peripherals of the photoconductor 10Y of yellow (Y) and the development device 30Y.

As peripherals of the photoconductor 10Y, there are provided along the rotation direction of the outer circumference of the photoconductor 10Y with respect to the corona charging device 11Y, the exposure unit 12Y, the development roller 20Y of the development device 30Y, a first photoconductor squeeze roller 13Y, a second photoconductor squeeze roller 13Y', the primary transfer portion 50Y, a static eliminator (not shown) eliminating a potential of the photoconductor 10Y, and a photoconductor cleaning blade 18Y. Also, in an image forming process, in an order from the corona charging device 11Y to the photoconductor cleaning blade 18Y, constituent elements arranged at a further forward position are defined to be positioned upstream as compared with constituent elements arranged at a further backward position.

The photoconductor 10Y is a photoconductive drum which is constituted by a cylindrical member where a photoconductive layer such as an amorphous silicon photoconductor or the like is formed on the outer circumferential surface, and rotates in the clockwise direction in FIG. 1. The corona charging device 11Y is arranged at the upstream side in the rotation direction of the photoconductor 10Y when seen from the nip portion between the photoconductor 10Y and the development roller 20Y, and is applied with a voltage from a power supply (not shown) to corona-charge the photoconductor 10Y. The exposure unit 12Y is arranged downstream when seen from the corona charging device 11Y and upstream when seen from the nip portion between the photoconductor 10Y and the development roller 20Y in the rotation direction of the photoconductor 10Y, irradiates light to the photoconductor 10Y charged by the corona charging device 11Y, and enables a latent image to be formed on the photoconductor 10Y.

In addition, the development device 30Y has the development roller 20Y carrying the above-described liquid developer, the anilox roller 32Y which is a supplying roller for supplying the liquid developer to the development roller 20Y, a limitation blade 33Y limiting the amount of the liquid developer supplied to the development roller 20Y, an auger 34Y which supplies the liquid developer to the anilox roller 32Y while stirring and transporting the liquid developer, a compaction corona generator 22Y which makes the liquid developer carried to the development roller 20Y lie in a compacted state, a development roller cleaning blade 21Y which cleans the development roller 20Y, and the developer reservoir 31Y which stores the liquid developer where toner is dispersed in a carrier at a proportion by weight of roughly 20%.

The liquid developer contained in the developer reservoir 31Y is a non-volatile liquid developer having high concentration, high viscosity, and non-volatility at room temperature, not a liquid developer which typically uses Isopar (trademark: Exxon) as a carrier in the related art and has low concentration (ranging from 1 to 2 wt %), low viscosity, and volatility at room temperature. That is to say, in the liquid developer according to an embodiment of the invention, solid particles, having an average particle diameter of 1 μm in which coloring agents such as pigments or the like are dispersed in thermoplastic resin, are added in a liquid solvent such as an organic solvent, a silicon oil, a mineral oil, an edible oil, or the like along with a disperser. The liquid developer has the concentration of solid contents of toner of about 20% and a high viscosity (HAAKE RheoStress Rs 600 is used, and the viscoelasticity is about 30 to 300 mPa·s in a shear velocity 1000 (l/s) at 25° C.)

As described above, although the development device 30Y of the Y color has been described, the development devices 30M, 30C and 30K of the other colors have the same configuration as well. In addition, an arranging order and the number of members such as photoconductors, the development devices or the like corresponding to the respective colors Y, M, C and K are not limited to those shown in FIG. 1, but they may be set arbitrarily. Further, a configuration of a single color is also possible.

Figure 2:
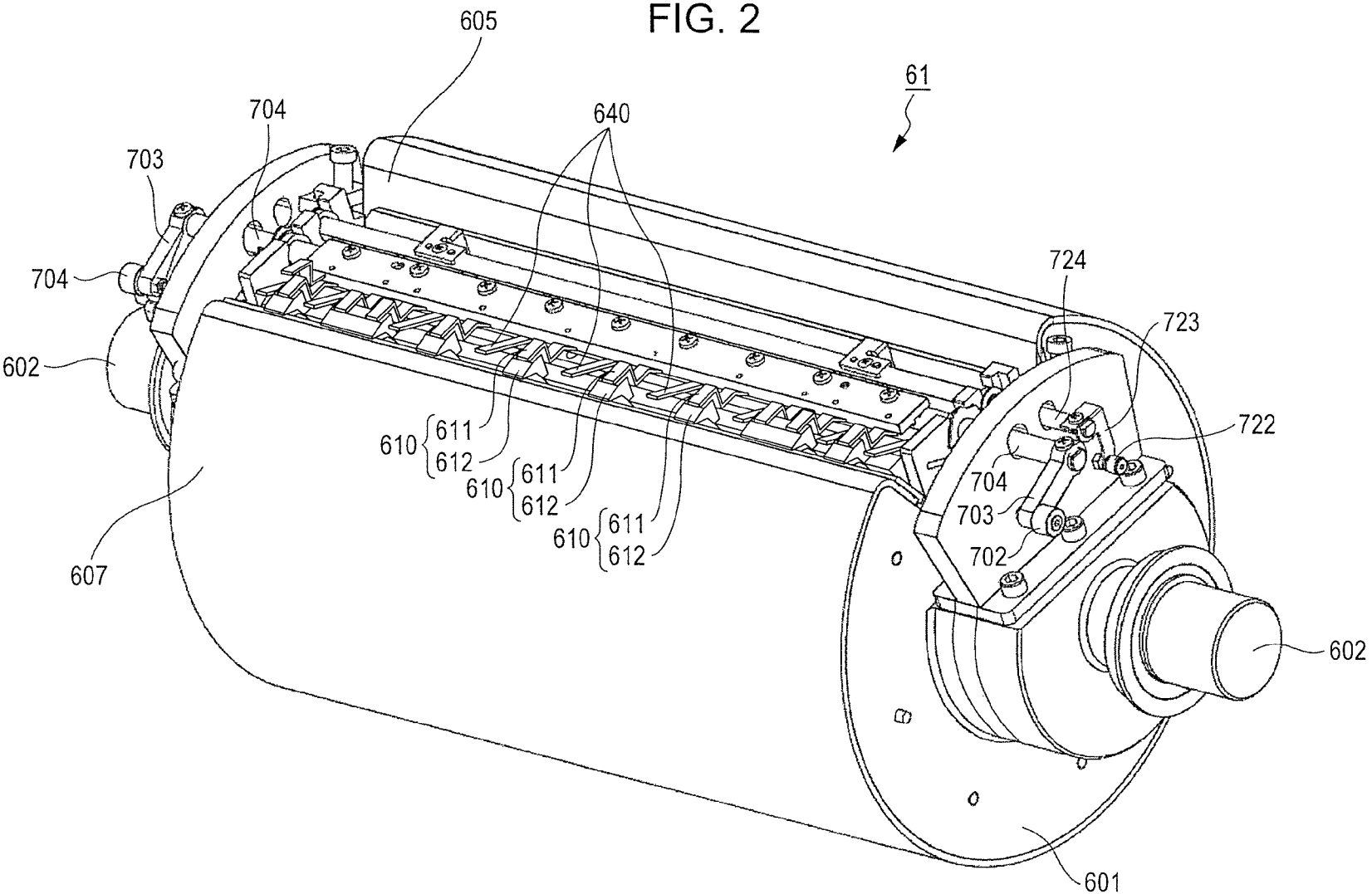
FIG. 2 is a perspective view of a secondary transfer roller.
Figure 3:
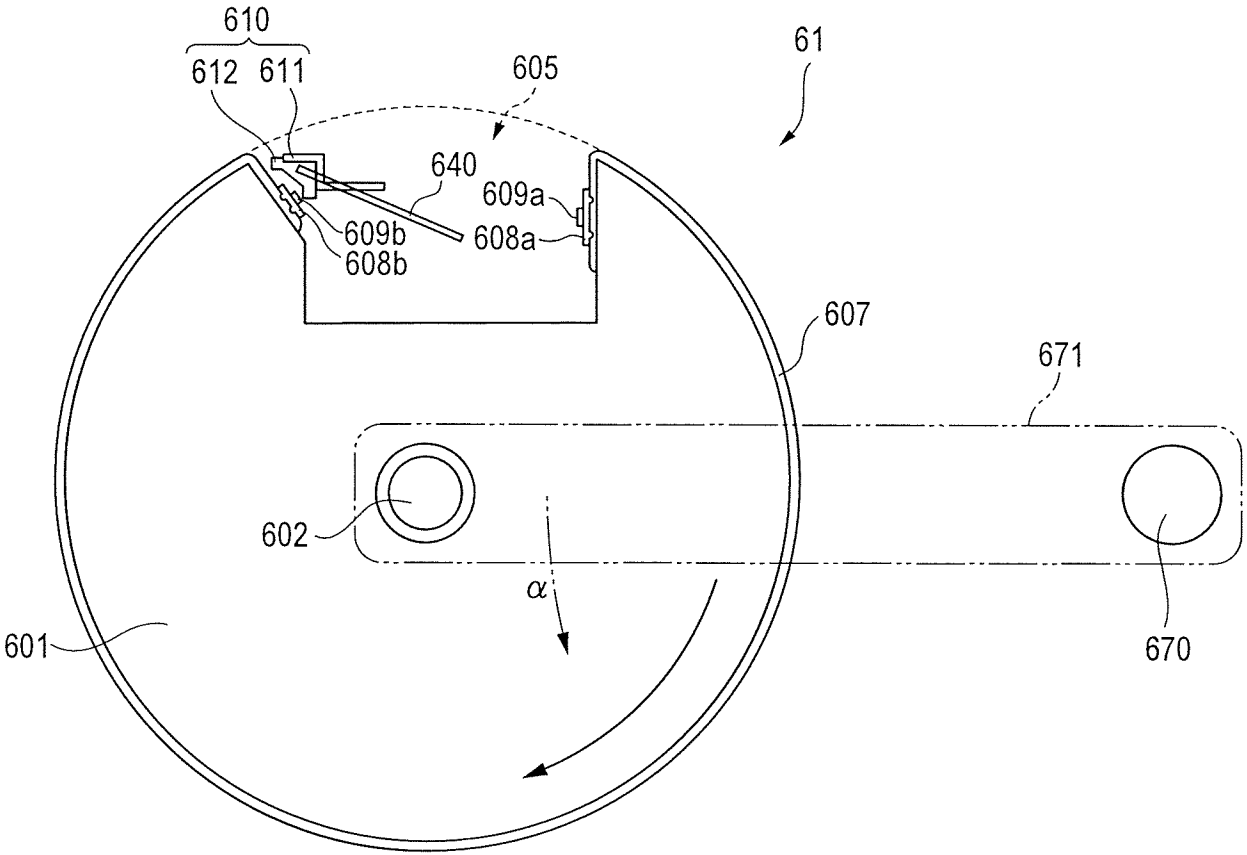
FIG. 3 is a sectional view of the secondary transfer roller.

Next, a configuration of the secondary transfer roller 61 will be described. FIG. 2 is a diagram illustrating the secondary transfer roller 61 according to an embodiment of the invention, and FIG. 3 is a sectional view of the secondary transfer roller 61. FIGS. 4 to 7 are diagrams illustrating states where a transfer material is transported when the secondary transfer roller 61 rotates, and FIGS. 8A to 8D are diagrams illustrating operations of a transfer material gripper 610 when the secondary transfer roller 61 rotates.

In FIGS. 2 and 3, the reference numeral 601 denotes a roller base material, the reference numeral 602 denotes roller shaft portions, the reference numeral 605 denotes a concaved portion, the reference numeral 607 denotes an elastic member, the reference numeral 610 denotes a transfer material gripper, the reference numeral 611 denotes a gripping member, the reference numeral 612 denotes a gripping member receiving portion, the reference numeral 640 denotes a transfer material peeling member, the reference numeral 650 denotes a contact member, the reference numeral 701 denotes a first cam, the reference numeral 702 denotes a first cam follower, the reference numeral 703 denotes a first cam follower arm, the reference numeral 704 denotes a first rotation shaft, the reference numeral denotes a second cam, the reference numeral 722 denotes a second cam follower, the reference numeral 723 denotes a second cam follower arm, and the reference numeral 724 denotes a second rotation shaft, respectively.

The roller shaft portions 602 are installed at both end portions of the roller base material 601 of the secondary transfer roller 61 which can be installed in a device main body side to rotate with respect to the roller shaft portions 602. The concaved portion 605 extending in the axial direction is provided in the roller base material 601, and the transfer material gripper 610 is provided in the concaved portion 605. The transfer material gripper 610 is a mechanism for gripping or releasing a transfer material.

The elastic member 607 which supports a transfer material is provided on the circumferential surface of the roller base material 601. The elastic member 607 is a member formed of a half-conductive elastic rubber layer having an electrical resistance component, and both ends thereof are fixed in the concaved portion 605 in a state of being wound on the roller base material 601. FIG. 3 shows a state where the elastic member 607 is fixed. One end of the elastic member 607 is fixed to the roller base material 601 by a fixing member 609*a* such as a screw or the like, along with a plate 608*a* which extends in the axial direction and contacts with the roller base material 601. The other end of the elastic member 607 is also reliably fixed to the roller base material 601 by a plate 608*b* and a fixing member 609*b*. In addition, the fixing of the elastic member 607 to the roller base material 601 is not limited thereto, but other methods may be used.

By winding the elastic member 607 around the secondary transfer roller 61, it is possible to secure a wider secondary transfer nip formed between the secondary transfer roller 61 and the transfer belt 40 and to increase transfer efficiency. In addition, by installing the fixing portions for fixing the elastic member 607 in the concaved portion 605 of the secondary transfer roller 61, it is possible to easily change the elastic member 607 without need of fixing the elastic member 607 to the surface of the secondary transfer roller 61.

In addition, the roller shaft portion 602 of the secondary transfer roller 61 is rotatably supported by a frame member 671. The frame member 671 rotates and oscillates with respect to a rotation support shaft portion 670 which is supported by the device main body, and is biased to the direction a indicated by the arrow by a biasing member (not shown). The secondary transfer roller 61 contacts with the belt driving roller 41 by a biasing force of the biasing member via the transfer belt 40 at a constant load.

As an outline, each of the transfer material grippers 610 includes a pair constituted by the gripping member 611 and the gripping member receiving portion 612 which are discretely provided in the roller axial direction, and a plurality of the transfer material peeling members 640 which is appropriately arranged between the pair in the roller axial direction. Each of the gripping members 611 is movable and operates to pinch a transfer material along with the gripping member receiving portion 612, thereby gripping the transfer material, or operates to open an interval between the transfer material and the gripping member receiving portion 612, thereby releasing the transfer material. Also, each of the transfer material peeling members 640 operates to push a transfer material, gripped by the gripping member 611 and the gripping member receiving portion 612, away from the secondary transfer roller 61 side.

Each of the gripping members 611 is fixed to the first rotation shaft 704, and opened and closed by the rotation of the first rotation shaft 704. Each end of the first rotation shaft 704 is provided with the first cam follower 702 supported by the first cam follower arm 703. The first cam follower arm 703 is always biased to a direction where the gripping member 611 is seated in the gripping member receiving portion 612, by an elastic member (not shown). The first cam follower 702 is a roller of which an axis is rotatably supported by the first cam follower arm 703.

Each of the transfer material peeling members 640 is fixed to the second rotation shaft 724, and opened and closed by the rotation of the second rotation shaft 724. Each end of the second rotation shaft 724 is provided with the second cam follower 722 supported by the second cam follower arm 723. The second cam follower arm 723 is always biased to a direction where the transfer material peeling member 640 is drawn into the concaved portion 605, by an elastic member (not shown). The second cam follower 722 is a roller of which an axis is rotatably supported by the second cam follower arm 723.

As described above, the main configuration of the secondary transfer roller 61 has been described with reference to FIGS. 2 and 3, and, next, transport of a transfer material using the secondary transfer roller 61 and an operation of the transfer material gripper 610 will be described in detail with reference to FIGS. 4 to 8D.

FIGS. 4 to 7 are diagrams of the secondary transfer roller 61 when seen from a side, and they sequentially show the movement of the first cam follower 702 and the operation of the transfer material gripper 610 when the secondary transfer roller 61 rotates. Also, FIGS. 8A to 8D are diagrams of the respective constituent elements of the transfer material gripper 610 shown schematically when seen from the axial direction. FIG. 8A, FIG. 8B, FIG. 8C, and FIG. 8D respectively show operation states performed by the transfer material gripper 610 when the transfer material gripper 610 of the secondary transfer roller 61 reaches the positions marked with A, B, C, and D at the secondary transfer roller 61 in FIG. 1.

As shown in FIGS. 4 to 7, one end of the secondary transfer roller 61 is provided with the first cam 701. The first cam 701 is a member fixed to the device main body, and is always positioned at the same place regardless of the rotation of the secondary transfer roller 61. The other end of the secondary transfer roller 61 is also provided with the first cam 701 symmetrical to the cam member 701 of the one end with respect to a plane perpendicular to the axial direction of the secondary transfer roller 61.

The first cam 701 has a circumferential surface with a predetermined thickness in the axial direction of the secondary transfer roller 61, and the first cam follower 702 moves in the state of being pressed to the circumferential surface due to the first cam follower arm 703 when the secondary transfer roller 61 rotates. The transfer material gripper 610 is opened and closed by the movement of the first cam follower 702.

Figure 4:
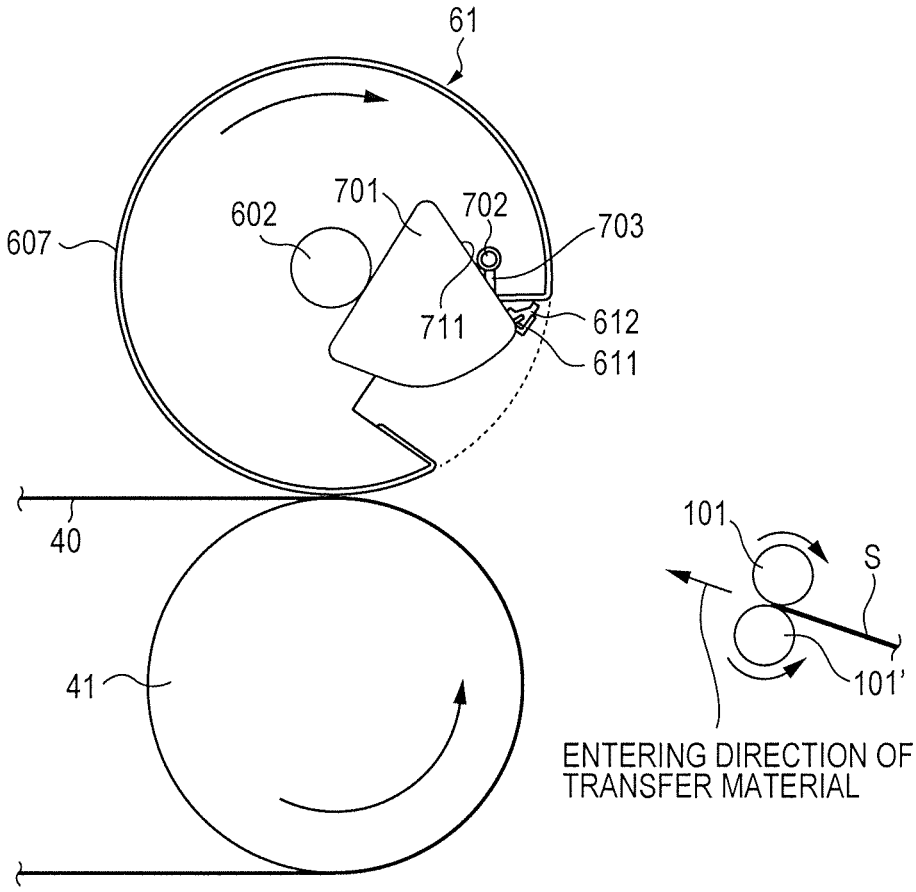
FIG. 4 is a diagram illustrating a state where a transfer material is transported when the secondary transfer roller rotates.
Figure 8A:
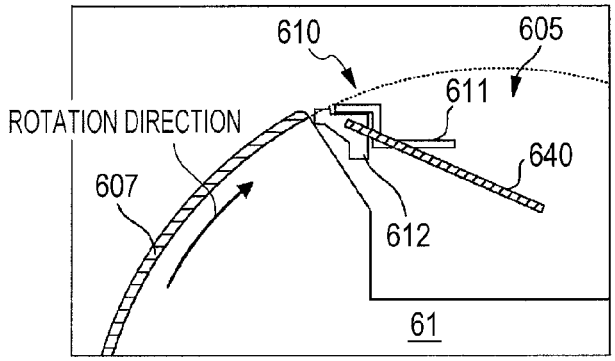
FIGS. 8A to 8D are diagrams illustrating an operation of a transfer material gripper of the secondary transfer roller.

FIG. 4 shows a state in the position marked with A at the secondary transfer roller 61 in FIG. 1. In this state, the first cam follower 702 is positioned at a first cam surface 711 of the first cam 701. The profile of the first cam surface 711 is linear or nearly linear and continuously separates from the center of the secondary transfer roller 61 when the rotation of the secondary transfer roller 61 progresses. In the state where the first cam follower 702 is positioned at the first cam surface 711, as shown in FIG. 8A, the gripping member 611 is set to be seated in the gripping member receiving portion 612.

Figure 5:
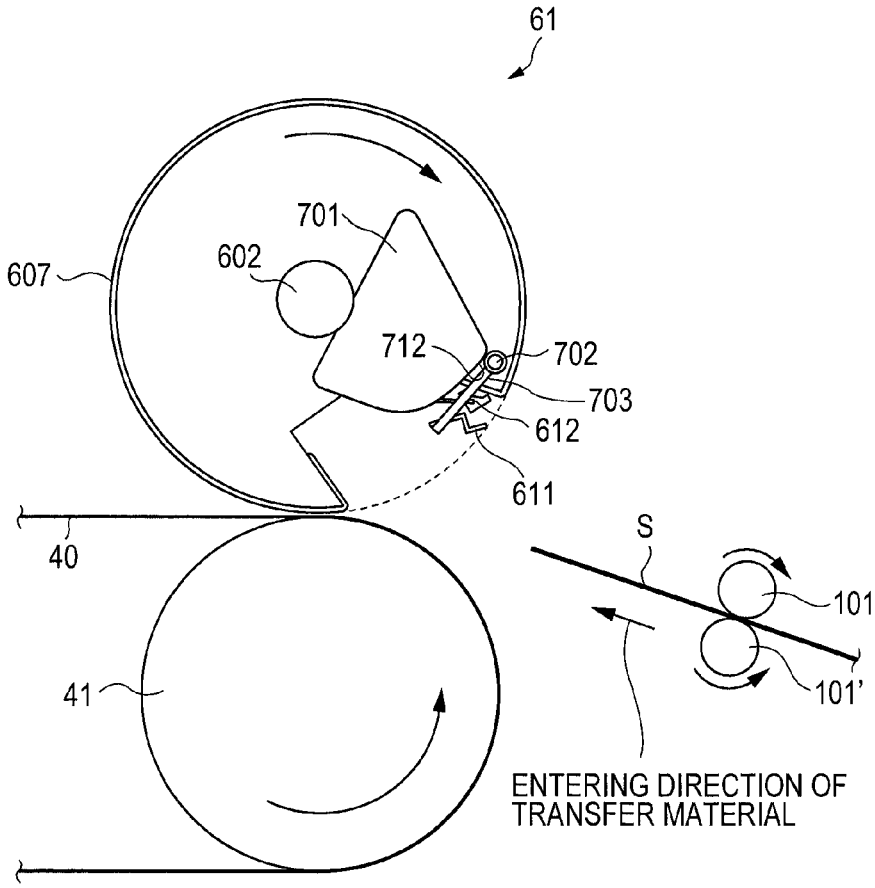
FIG. 5 is a diagram illustrating a state where a transfer material is transported when the secondary transfer roller rotates.

FIG. 5 shows the state where the secondary transfer roller 61 further rotates from the state shown in FIG. 4, and shows the state where the first cam follower 702 is positioned at a second cam surface 712 which is the farthest from the center of the secondary transfer roller 61. By the movement of the first cam follower 702, the gripping member 611 of the transfer material gripper 610 is changed from the state of being seated in the gripping member receiving portion 612 to the state of being separated therefrom, and is ready to grip a transfer material S transported by the gate rollers 101 and 101'.

Figure 6:
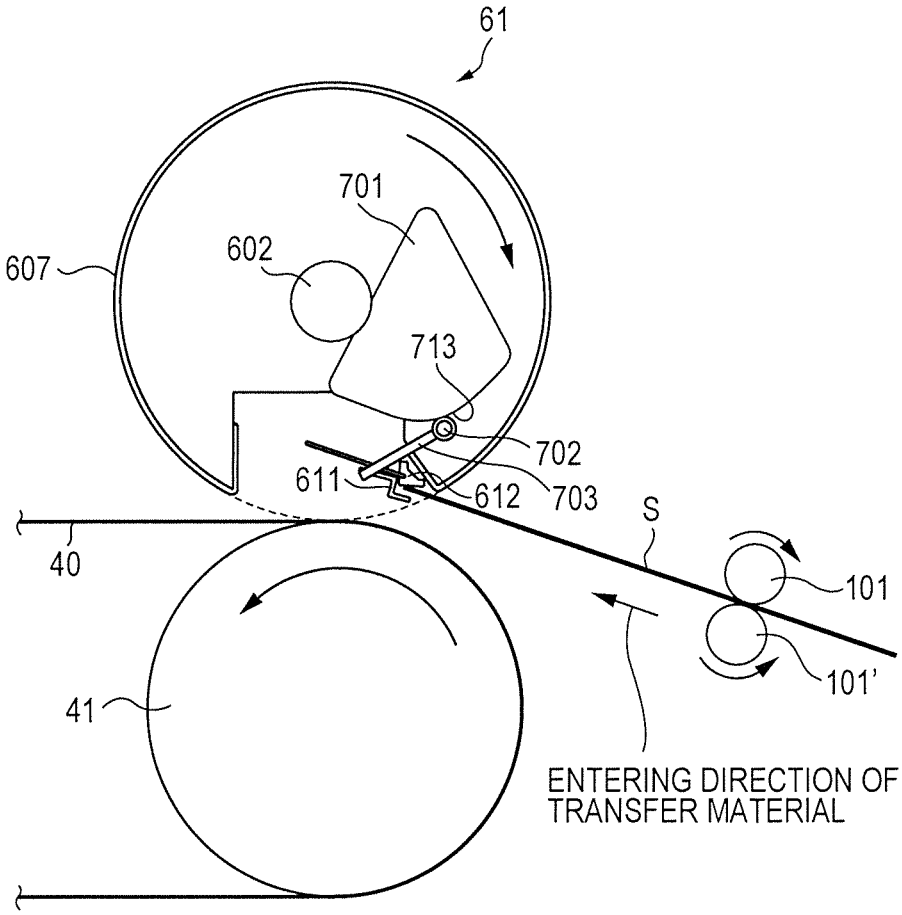
FIG. 6 is a diagram illustrating a state where a transfer material is transported when the secondary transfer roller rotates.
Figure 8B:
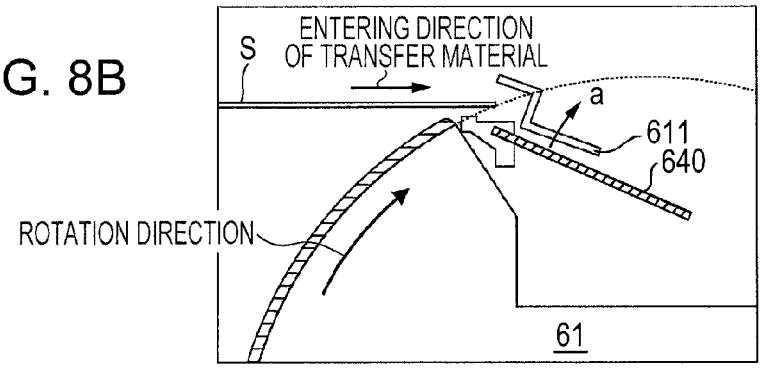

FIG. 6 is a diagram illustrating the state in the position marked with B at the secondary transfer roller 61 in FIG. 1. FIG. 8B shows an enlarged view of the transfer material gripper 610 in this state. FIG. 8B shows the state where the gripping member 611 moves in the direction a to generate a predetermined space between the transfer material and the gripping member receiving portion 612, and the gripping member 611 is ready to pinch the transfer material S entering the space along with the gripping member receiving portion 612.

Figure 7:
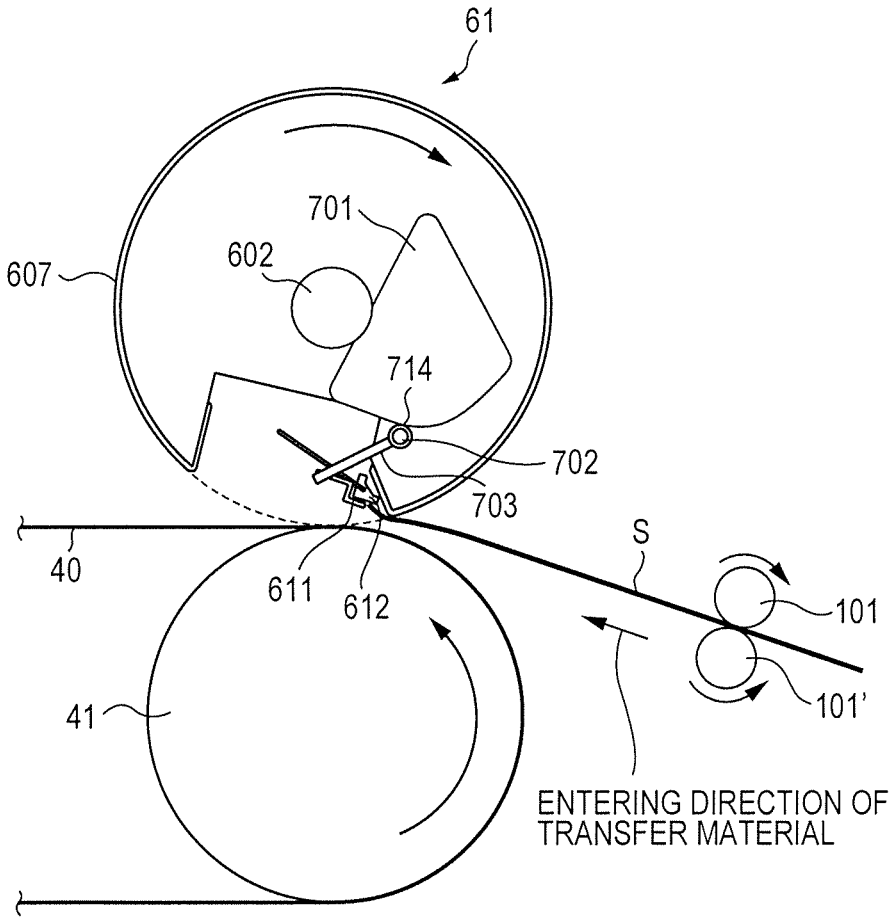
FIG. 7 is a diagram illustrating a state where a transfer material is transported when the secondary transfer roller rotates.

FIG. 7 shows the state where the secondary transfer roller 61 further rotates from the state shown in FIG. 6, and shows the state where the first cam follower 702 is positioned at a fourth cam surface 714 of the first cam 701. Since the circumferential surface of the first cam 701 has the profile where the distance from the center of the secondary transfer roller 61 decreases from a third cam surface 713 to the fourth cam surface 714, in the transfer material gripper 610, in the state where the first cam follower 702 is positioned at the fourth cam surface 714, as shown in FIG. 8C, the gripping member 611 moves in the direction a' to pinch the transfer material S having entered the space along with the gripping member receiving portion 612.

At this time, the transfer material S of which one end is pinched by the transfer material gripper 610 is wound by the secondary transfer roller 61 in accordance with the rotation of the secondary transfer roller 61. In this way, since the transfer material S is gripped and fixed by the transfer material gripper 610 at the front portion where the transfer material S enters the secondary transfer nip, the positioning of the transfer material S onto which toner images are transferred can be accurately performed. In the rotation procedure of the secondary transfer roller 61, the state shown in FIG. 8C is maintained when the transfer material gripper 610 is positioned in the range of C in FIG. 1.

Figure 8C:
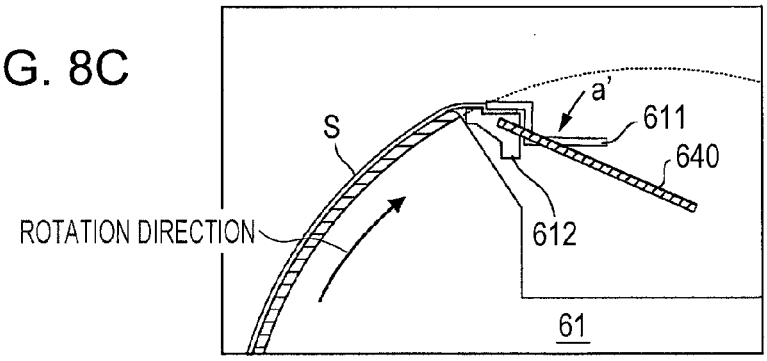
Figure 8D:
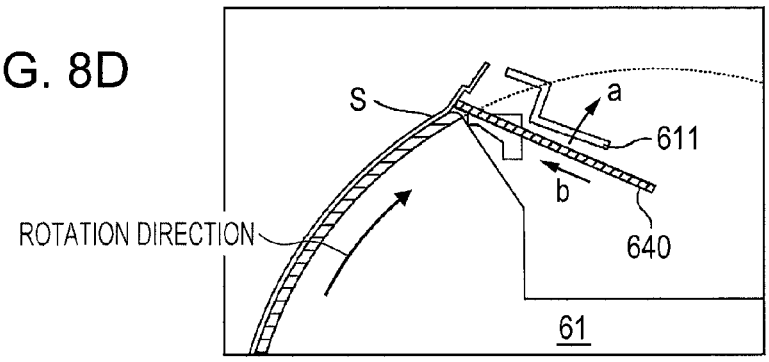

FIG. 8D shows the state where the secondary transfer roller 61 further rotates from the state shown in FIG. 7 (FIG. 8C). The first cam follower 702 moves along the circumferential surface of the first cam 701, and thereby the gripping member 611 moves in the direction a to generate a predetermined space between the transfer material S and the gripping member receiving portion 612 so as to release the transfer material S. In addition, the transfer material peeling member 640 moves in the direction b to push the transfer material S away from the secondary transfer roller 61. The transfer material peeling member 640 is driven by the second cam follower 722 moving along the circumferential surface of the first cam 701 like the first cam follower 702. This operation state, during the rotation of the secondary transfer roller 61, corresponds to a state where the transfer material gripper 610 comes to the position D in FIG. 1, and the transfer material S onto which toner images are transferred while passing through the secondary transfer nip is delivered to a subsequent transfer material transport process.

As described above, the transfer material gripper 610 grips the transfer material S before the transfer material S is inserted into the secondary transfer nip between the transfer belt 40 and the secondary transfer roller 61. Also, the transfer material gripper 610 is operated so as to release the gripped transfer material S after the transfer material S is inserted into the secondary transfer nip between the transfer belt 40 and the secondary transfer roller 61. The transfer material S having passed through the secondary transfer nip can be reliably guided to a next process by the transfer material gripper 610 being operated as shown in FIG. 8D so as to reliably separate the transfer material S from the secondary transfer roller 61.

In this embodiment, since the transfer material gripper 610 and the transfer material peeling member 640 are driven by the cam mechanisms such as the first cam follower 702, the second cam follower 722, the first cam 701 and the like, they can reliably work in accordance with the rotation of the secondary transfer roller 61. The driving of the transfer material gripper 610 and the transfer material peeling member 640 are not limited to such an aspect but may be electrically performed, for example, by a driving means such as a motor or the like based on a rotation position of the secondary transfer roller 61 detected by a sensor.

Next, there will be description of a structure where the secondary transfer roller 61 provided in the concaved portion 605 applies a predetermined pressure to the secondary transfer nip and limits a position between the secondary transfer roller 61 and the belt driving roller 41.

Figure 9:
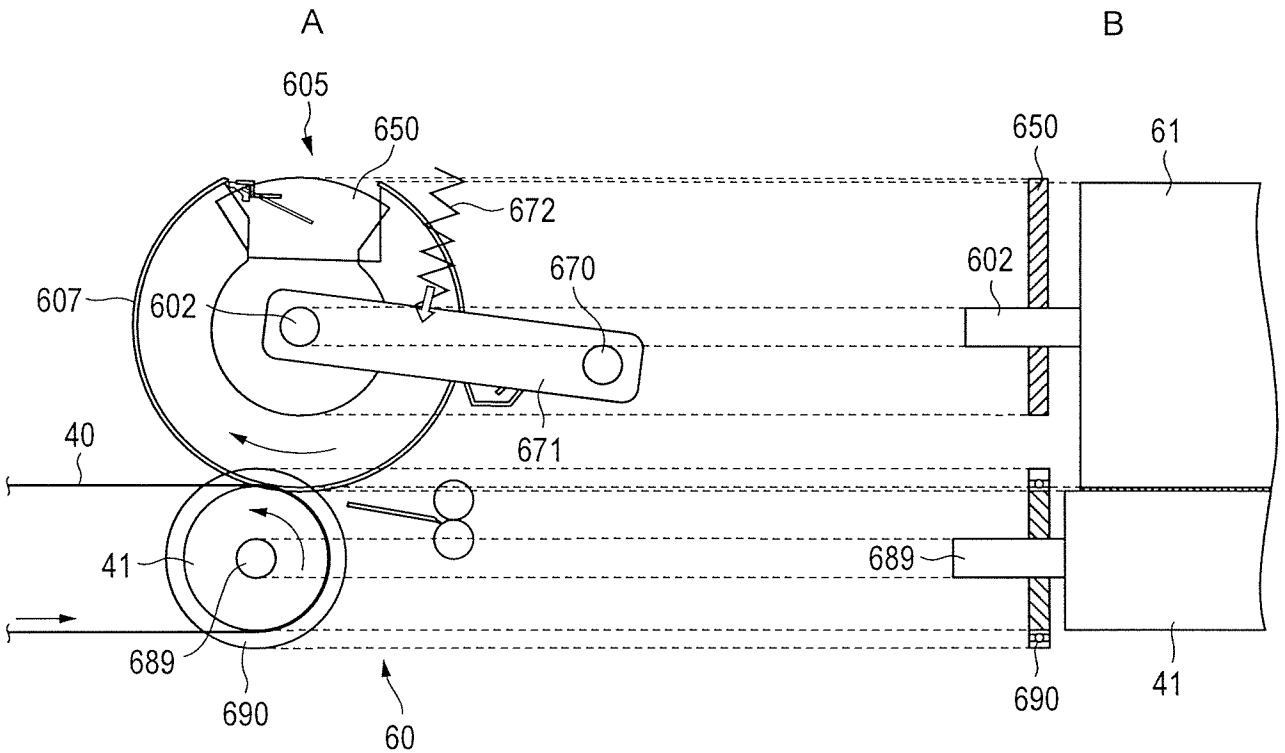
FIG. 9 is a diagram illustrating a state where the secondary transfer roller rotates.
Figure 10:
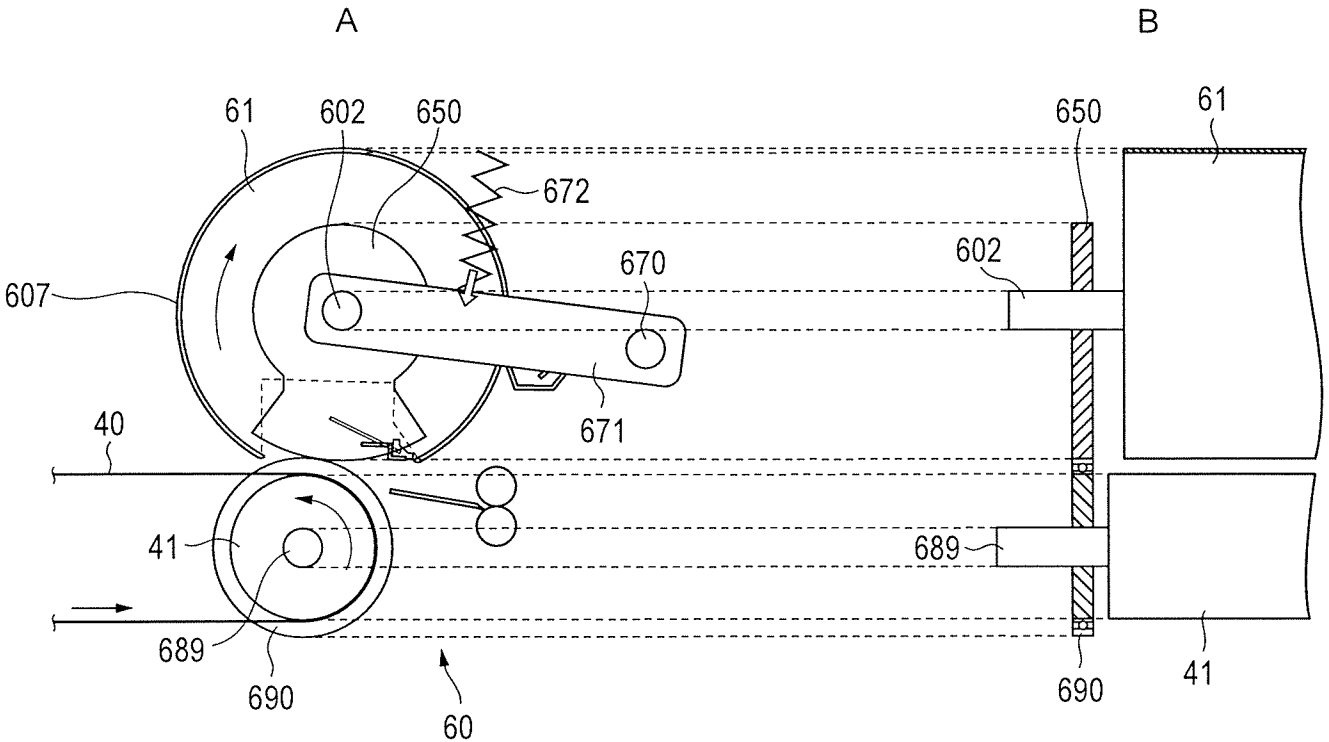
FIG. 10 is a diagram illustrating a state where the secondary transfer roller rotates.

FIGS. 9 and 10 are diagrams illustrating an operation of the secondary transfer unit 60 in the image forming device according to the embodiment of the invention. A in both of the figures shows the secondary transfer unit 60 when seen from the side of the device, and B therein shows a schematic section of the secondary transfer unit 60. In FIGS. 9 and 10, the reference numeral 650 denotes the contact member, the reference numeral 670 denotes the rotation support shaft portion, the reference numeral 671 denotes the frame member, the reference numeral 672 denotes a biasing member, the reference numeral 689 denotes a roller shaft portion of the belt driving roller 41, and the reference numeral 690 denotes a support member, respectively.

In the secondary transfer unit 60, both ends of the roller shaft portion 602 of the secondary transfer roller 61 are rotatably installed to the frame member 671. In addition, the frame member 671 can rotate with respect to the rotation support shaft portion 670 and is biased to the direction indicated by the arrow in the figures due to the biasing member 672. By such a structure, the secondary transfer roller 61 can be biased to the belt driving roller 41 side to apply a predetermined pressure to the secondary transfer nip between the secondary transfer roller 61 and the belt driving roller 41. Due to the transfer pressure and the transfer bias at the secondary transfer nip, toner particles on the transfer belt 40 are efficiently transferred to the transfer material side at the secondary transfer nip.

The contact member 650 is provided in each end of the roller shaft portion 602 of the secondary transfer roller 61. The support member 690 is provided in each end of the roller shaft portion 689 of the belt driving roller 41 in order to correspond to the contact member 650. As shown in B of FIGS. 9 and 10, the contact member 650 and the support member 690 are installed to be arranged in order in the axial direction.

The secondary transfer unit 60 sequentially repeats the state shown in FIG. 9 and the state shown in FIG. 10 in accordance with the rotation operations of the respective rollers. FIG. 9 shows the state where the concaved portion 605 does not face the belt driving roller 41 (or the transfer belt 40). At this time, a biasing force from the biasing member 672 is associated with the secondary transfer nip so as to secure a predetermined transfer pressure, and an appropriate transfer bias is applied between the secondary transfer roller 61 and belt driving roller 41. Thereby, toner particles on the transfer belt 40 are transferred to the transfer material side at the secondary transfer nip. In this state, the contact member 650 and the support member 690 are separated completely from each other and thus a position limitation due to the contact member 650 and the support member 690 does not apply.

FIG. 10 shows the state where the concaved portion 605 faces the belt driving roller 41 (or the transfer belt 40). At this time, a contact surface (contact region) of the contact member 650 contacts with the support member 690, and a biasing force of the secondary transfer roller 61 which is biased by the biasing member 672 is received by the support member 690 such that the distance and the positional relationship between the secondary transfer roller 61 and the belt driving roller 41 are maintained.

According to the embodiment described above, although the secondary transfer roller 61 is biased to the belt driving roller 41 side, since the roller shaft portion 602 of the secondary transfer roller 61 is provided with the contact member 650, and the roller shaft portion 689 of the belt driving roller 41 is provided with the support member 690, it is possible to maintain the positional relationship between the secondary transfer roller 61 and the belt driving roller 41 when the concaved portion 605 faces the transfer belt 40, that is, when the concaved portion 605 does not contact with the transfer belt 40.

Figure 11:
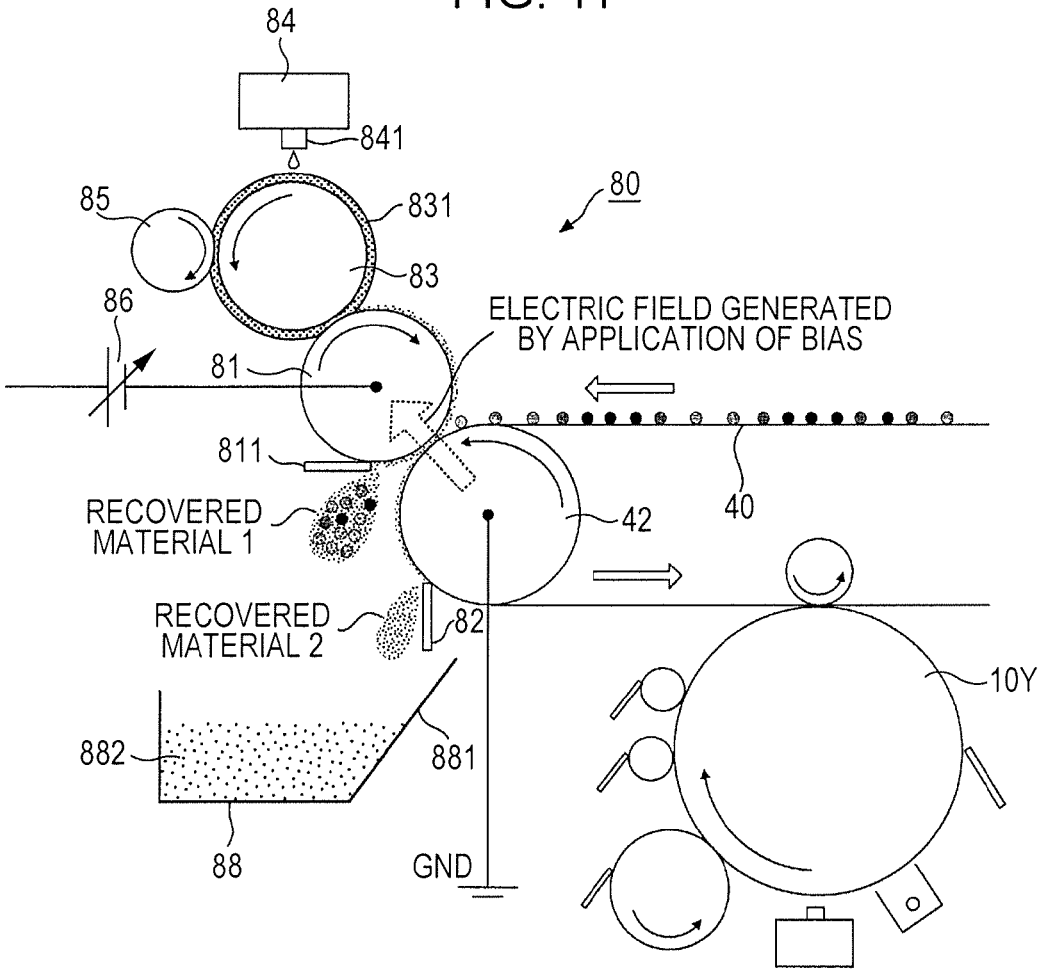
FIG. 11 is a diagram illustrating a main configuration of a cleaning device.

Next, the cleaning device 80 which cleans the surface of the transfer belt 40 will be described in more detail. FIG. 11 is a diagram illustrating an outline of the cleaning device usable in the image forming device 80 according to an embodiment of the invention. In FIG. 11, the reference numeral 81 denotes a cleaning roller, the reference numeral 811 denotes a cleaning roller cleaning blade, the reference numeral 82 denotes a transfer belt cleaning blade, the reference numeral 83 denotes a coating roller, the reference numeral 831 denotes a sponge outer circumferential portion, the reference numeral 85 denotes a leveling roller, the reference numeral 88 denotes a tank, the reference numeral 881 denotes a tank receiving portion, and the reference numeral 882 denotes a tank storage portion, respectively.

The cleaning roller 81 is arranged opposite to the tension roller 42 with the transfer belt 40 interposed therebetween, and contacts with the transfer belt 40 to clean the surface of the transfer belt 40. The cleaning roller 81 may use conductive urethane rubber as a base material, a surface layer of which is covered with conductive urethane coating so as to reduce the roughness of the surface.

The cleaning roller 81 is applied with a bias voltage by a bias application portion 86. In this embodiment, the cleaning roller 81 is applied with a predetermined voltage with a negative polarity and the tension roller 42 is grounded to generate an electric field between the cleaning roller 81 and the tension roller 42. Toner particles charged to a positive polarity are attracted toward the cleaning roller 81 side by the electric field, and the cleaning roller 81 can efficiently recover the toner particles on the transfer belt 40.

The bias application portion 86 in this embodiment can vary the bias applied to the cleaning roller 81 under the control of a controller and thus appropriately vary the bias depending on the state, the amount and the like of the toner particles on the transfer belt 40 to be cleaned. More specifically, it is possible to increase an electric field generated between the tension roller 42 and the cleaning roller 81 and to raise the recovery efficiency of the toner by setting a high absolute value of the bias applied to the cleaning roller 81 by the bias application portion 86.

The cleaning roller cleaning blade 811 is an elastic blade which has a rubber portion constituted by urethane rubber contacting with the surface of the cleaning roller 81, contacts with the cleaning roller 81, and performs the cleaning by scraping and dropping the toner particles and the carrier liquid on the cleaning roller 81. The recovered materials 1 scraped and dropped by the cleaning roller cleaning blade 811 include more toner particles than the recovered materials 2 recovered by the transfer belt cleaning blade 82 described later.

The recovered materials 1 scraped and dropped by the cleaning roller cleaning blade 811 fall down on the tank receiving portion 881 of the tank 88, and finally are stored in the tank storage portion 882.

The transfer belt cleaning blade 82 is arranged opposite to the tension roller 42 with the transfer belt 40 interposed therebetween. The transfer belt cleaning blade 82 is constituted by an elastic blade or the like which has a rubber portion formed of urethane rubber contacting with the surface of the transfer belt 40, and performs the cleaning by scraping and dropping the carrier liquid remaining on the transfer belt 40 which has been cleaned by the cleaning roller 81. Like the recovered materials 1, it is possible for the recovered materials 2 scraped and dropped by the transfer belt cleaning blade 82 to fall down onto the tank receiving portion 881 of the tank 88 and be stored in the tank storage portion 882.

The coating roller 83 (a "coating member" in the embodiment of the invention) is a roller which coats the carrier liquid to the cleaning roller 81, and is provided with a sponge member at the outer circumferential portion (sponge outer circumferential portion 831) in this embodiment. The cleaning roller 81 which has been coated with the carrier liquid by the coating roller 83 becomes wet, and the carrier liquid is sufficiently supplied to the nip portion between the cleaning roller 81 and the transfer belt 40 (tension roller 42). In this state, since the cleaning roller 81 is applied with the bias voltage for attracting the toner particles in the liquid developer, it is possible to obtain good cleaning characteristics.

Figure 12:
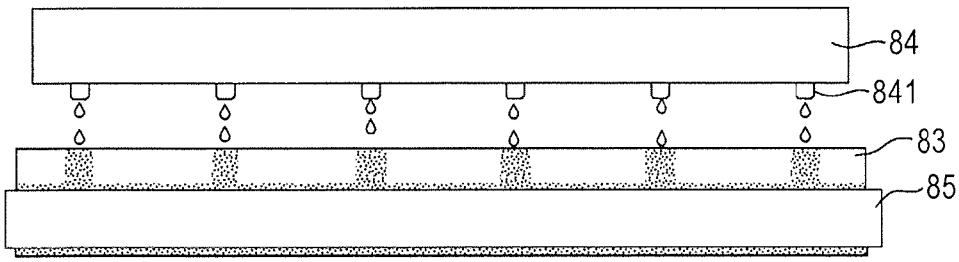
FIG. 12 is a schematic diagram illustrating a coating roller and a dropping device when seen from a direction perpendicular to an axial direction.

A dropping device 84 drops and supplies the carrier liquid to the coating roller 83 and is provided with a nozzle 841 in its lower portion, which discharges the carrier liquid. FIG. 12 is a schematic diagram of the coating roller 83, the dropping device 84, and the leveling roller 85 when seen from the direction perpendicular to the roller axial direction. The nozzles 841 of the dropping device 84 are disposed at a substantially uniform interval in the axial direction, and supply the carrier liquid to the coating roller 83 which is placed directly under it.

The coating roller 83 which has been supplied with the carrier liquid rotates towards the leveling roller 85 in the counterclockwise direction as shown in FIG. 11, the sponge outer circumferential portion 831 is pressed by the leveling roller 85, and thereby the carrier liquid in the sponge outer circumferential portion 831 becomes widely spread in the axial direction of the coating roller 83.

Figure 13:
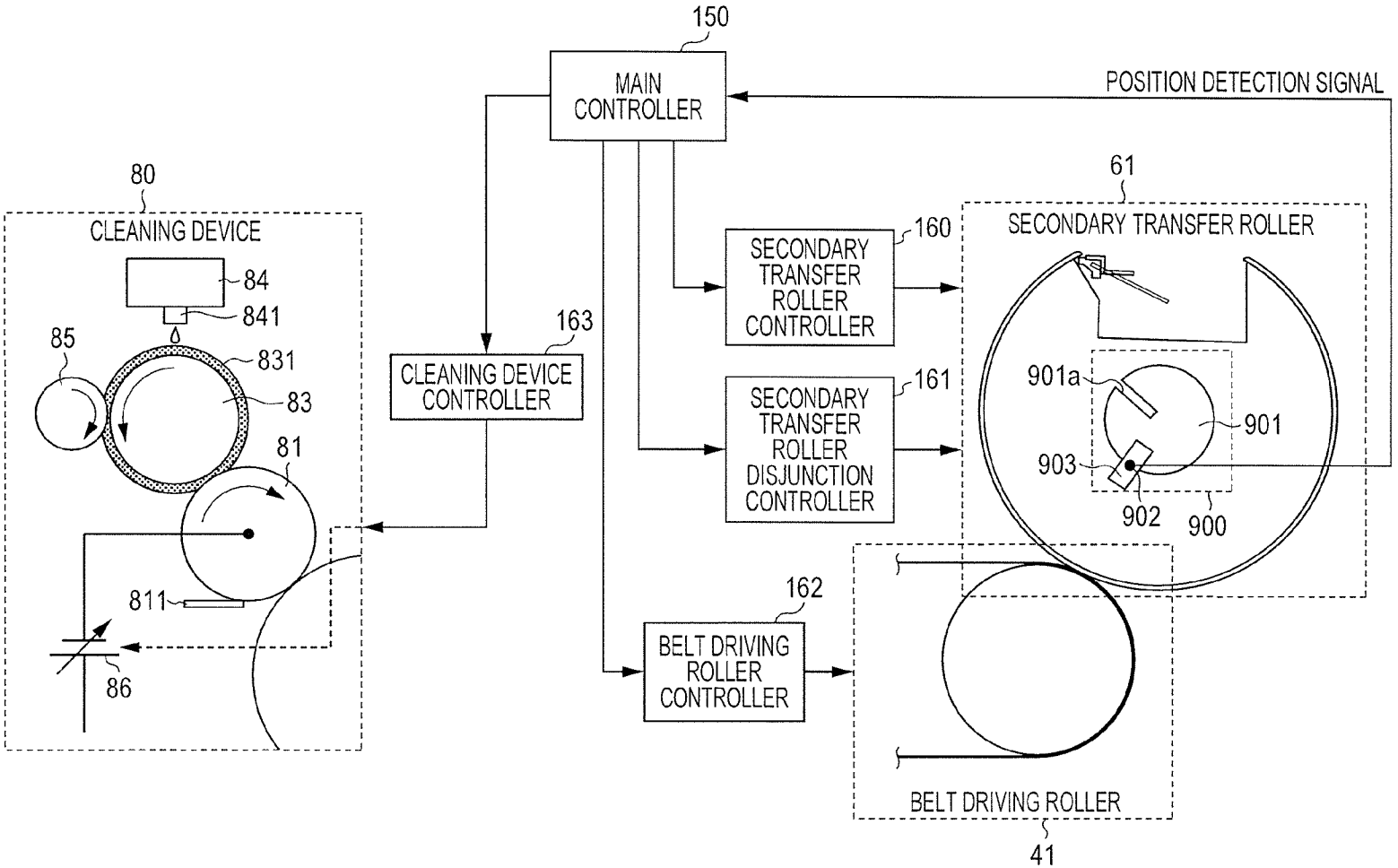
FIG. 13 is a block diagram illustrating a control in the image forming device.

A control in the image forming device according to an embodiment of the invention will now be described. FIG. 13 is a schematic diagram of a control block in the image forming device according to an embodiment of the invention. In FIG. 13, the reference numeral 150 denotes a main controller, the reference numeral 160 denotes a secondary transfer roller controller, the reference numeral 161 denotes a secondary transfer roller disjunction controller, the reference numeral 162 denotes a belt driving roller controller, the reference numeral 163 denotes a cleaning device controller, the reference numeral 900 denotes a position detector, the reference numeral 901 denotes a detected member, the reference numeral 901*a* denotes a slit, the reference numeral 902 denotes a sensor, and the reference numeral 903 denotes a sensor support member, respectively.

The main controller 150 controls the respective elements of the image forming device according to the embodiment of the invention. The main controller 150 may be implemented by using a general information processing device including a CPU or RAM, ROM, and the like and by storing programs which direct the CPU to output commands to a predetermined block based on input predetermined information stored in the ROM in advance.

The belt driving roller controller 162 controls starting and stopping of rotation, and circumferential velocity of rotation, and the like, for the belt driving roller 41, based on a control command from the main controller 150, and controls the movement of the transfer belt 40 wound on the belt driving roller 41.

The secondary transfer roller controller 160 controls starting and stopping of rotation, and circumferential velocity of rotation, and the like, for the secondary transfer roller 61, based on a control command from the main controller 150. In this embodiment, the transfer material gripping member 611 is opened and closed by the constituent elements such as the first cam 701 and the first cam follower 702 in accordance with the rotation of the secondary transfer roller 61, and when the transfer material gripping member 611 is driven electrically, the transfer material gripping member 611 can vary a timing of gripping a transfer material or a timing of releasing a transfer material under the control of the secondary transfer roller controller 160.

The secondary transfer roller disjunction controller 161 controls a mechanism used to vary a distance between axes of the secondary transfer roller 61 and the belt driving roller 41. If the cleaning device 80 cleans the transfer belt 40 in the state where the secondary transfer roller 61 contacts with the transfer belt 40, there is a problem in that the liquid developer remaining on the transfer belt 40 contaminates the secondary transfer roller 61. The secondary transfer roller disjunction controller 161 is provided for solving this problem, and drives the mechanism to vary the distance between axes of the secondary transfer roller 61 and the belt driving roller 41. When the distance between the axes varies manually, the secondary transfer roller disjunction controller 161 may be omitted.

The position detector 900 is a member which is installed for detecting a rotation position of the secondary transfer roller 61, detects a rotation reference position of the secondary transfer roller 61, and outputs a position detection signal to the main controller 150. In this embodiment, the position detector 900 includes the detected member 901, the slit 901*a*, the sensor 902, and the sensor support member 903.

The detected member 901 is fixed to the roller shaft portion 602 of the secondary transfer roller 61 and is a circular member which rotates along with the secondary transfer roller 61. The sensor 902 is fixed to the image forming device main body, and is installed so as to not rotate along with the secondary transfer roller 61. In the sensor 902, a light emitting portion and a light sensing portion are disposed opposite to each other with the detected member 901 interposed therebetween.

The slit 901*a* provided in the detected member 901 passes between the light emitting portion and the light sensing portion in accordance with the rotation of the secondary transfer roller 61, the light sensing portion enters an ON state where the light sensing portion senses light from the light emitting portion when the slit 901*a* passes therebetween, and the light sensing portion enters an OFF state when the slit 901*a* does not pass therebetween. In this embodiment, it is possible to detect a reference position of the secondary transfer roller 61 by a position detection signal output from the position detector 900 which uses such an optical system. The detection of the reference position is not necessarily performed by this aspect, but may be performed by a proper aspect, for example, by using a mechanical detection means or the like.

The cleaning device controller 163 controls the cleaning device 80 installed for cleaning the transfer belt 40, and, specifically, controls the rotation driving of the coating roller 83 and the cleaning roller 81, the amount of the carrier liquid dropped from the nozzle 841 of the dropping device 84, the amount of bias for the bias application portion 86, and the like. Particularly, in this embodiment, an absolute value of the bias added to the bias application portion 86 is controlled to be set greater during cleaning than during typical printing, and the toner remaining on the transfer belt 40 can be recovered efficiently.

Figure 14:
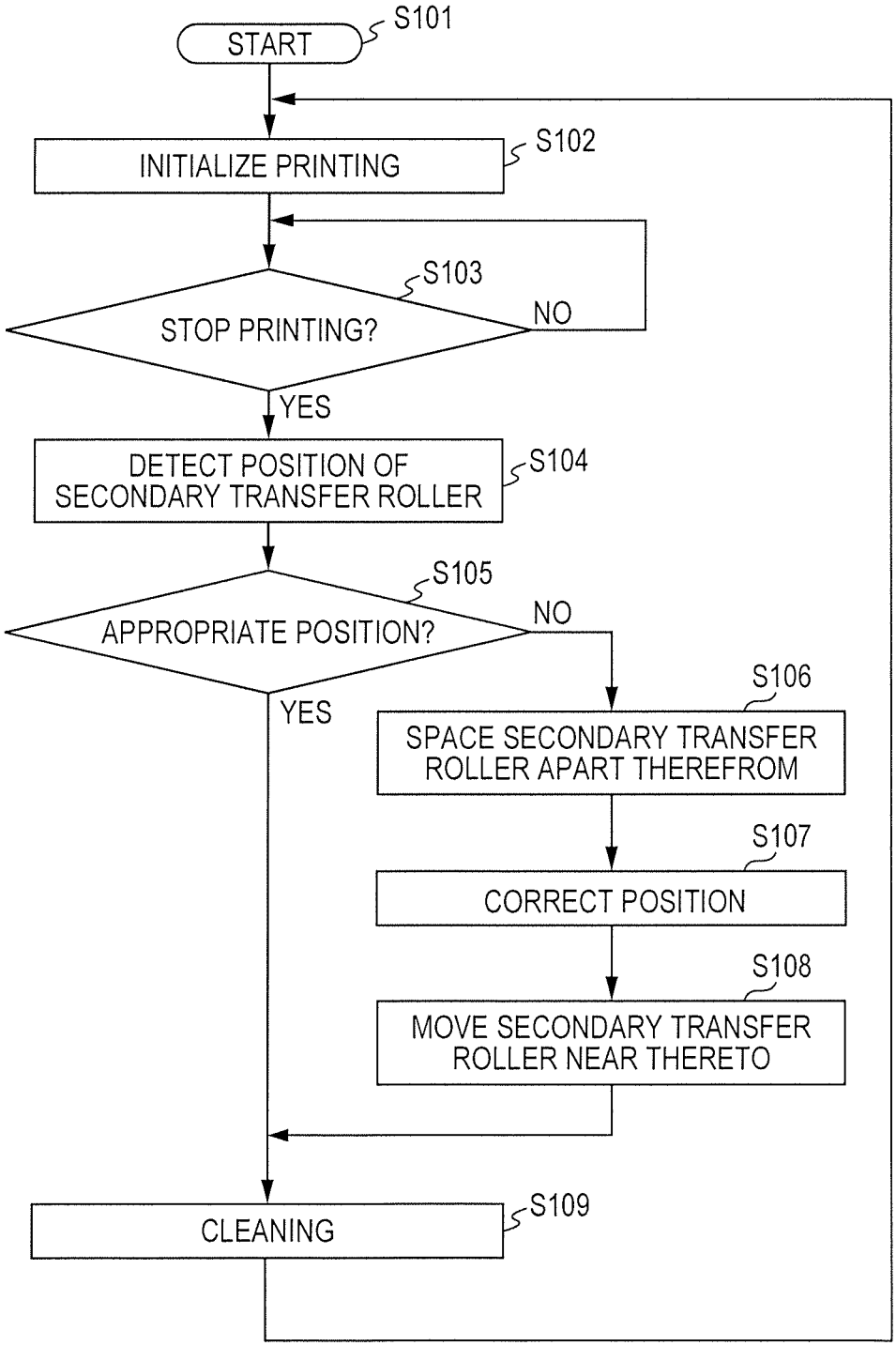
FIG. 14 is a flowchart illustrating a disjunction processing for the secondary transfer roller.
Figure 15:
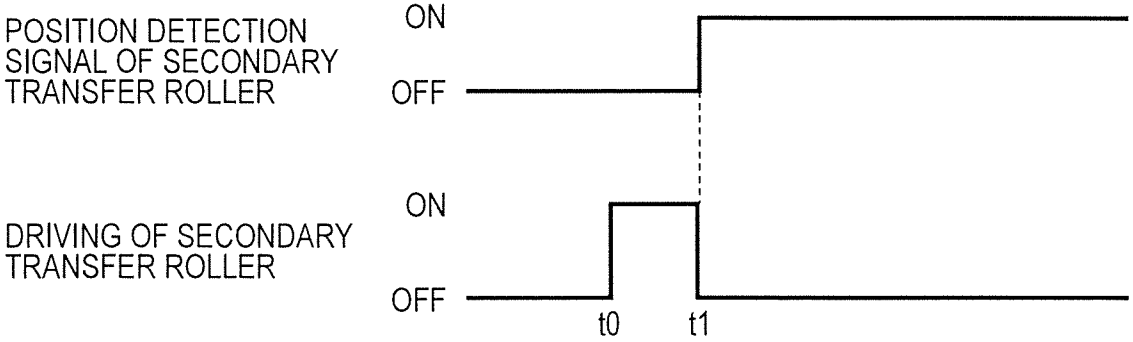
FIG. 15 is a diagram illustrating a sequence of a position correction processing for the secondary transfer roller.

Next, there will be description of a disjunction processing for the secondary transfer roller 61 according to an embodiment of the invention with reference to FIGS. 14 and 15. FIG. 14 is a flowchart illustrating the disjunction processing for the secondary transfer roller 61 according to an embodiment of the invention, and FIG. 15 is a diagram illustrating a sequence of a position correction processing for the secondary transfer roller 61.

The image forming device is powered on at step S101, and, at step S102, when printing is initialized in response to a printing start signal, various kinds of rollers including the secondary transfer roller 61 are driven. At step S103, a state of the initialized printing is monitored, and when the printing is stopped, the flow goes to the following processing. The stopped printing states include ones caused not only by a normal ending of the printing, but also various conditions, for example, clogging of a transfer material in a transport path, so-called paper jam, loss of power supply during printing by operation of a power switch or power outage, or the like.

If the printing is determined to be stopped at step S103, a rotation position of the secondary transfer roller 61 is detected by the position detector 900 at step S104, and, at step S105, it is determined whether or not a corresponding rotation position is an appropriate position. The appropriate position means a rotation position of the secondary transfer roller 61 where the secondary transfer roller 61 and the transfer belt 40 do not contact with each other, and corresponds to a position where the concaved portion 605 faces the belt driving roller 41. Whether or not the secondary transfer roller 61 comes to the appropriate position may be directly detected by the sensor 902, for example, by the sensor 902 detecting the slit 901*a*, or may be indirectly detected based on the rotation reference position of the secondary transfer roller 61 and the amount of rotation of the secondary transfer roller 61 output from the position detector 900.

When it is determined that the secondary transfer roller 61 does not come to an appropriate position at step S105, the secondary transfer roller 61 is controlled to come to an appropriate position through processing at steps S106 to S108. First, at step S106, the secondary transfer roller 61 is made to be separated from the transfer belt 40 with which it contacts, that is, the distance between axes of the secondary transfer roller 61 and the belt driving roller 41 where the transfer belt 40 is wound and hung may be increased.

At step S107, a position correction is performed such that the secondary transfer roller 61 rotates and comes to an appropriate position. FIG. 15 is a diagram illustrating a sequence of such position correction processing and shows a position detection signal from the position detector 900 and a driving form of the secondary transfer roller 61. In this embodiment, the appropriate position is directly detected by the position detector 900, and when the position detection signal is output from the position detector 900, the secondary transfer roller 61 comes to the appropriate position. In this case, the secondary transfer roller 61 rotates such that the secondary transfer roller 61 comes to an appropriate position, until the position detection signal is output from the position detector 900. When the position detection signal output from the position detector 900 indicates a proper reference position of the secondary transfer roller 61, it is possible to lead the secondary transfer roller 61 to the appropriate position from the reference position by a predetermined amount of rotation.

At step S108, the secondary transfer roller 61 which has come to the appropriate position is moved near to the transfer belt 40, that is, the distance between axes of the secondary transfer roller 61 and the belt driving roller 41 is decreased. In this state, the secondary transfer roller 61 can prepare for start of subsequent printing.

At step S109, in preparation of subsequent printing, the transfer belt 40 is cleaned by the cleaning device 80. The entire circumference of the transfer belt 40 is cleaned by one rotation of the transfer belt 40, but, in the jamming processing, when an image remaining on the transfer belt 40 is cleaned before the image is transferred to a transfer material, the transfer belt 40 may be rotated and cleaned to an extent that the corresponding image is cleaned by the cleaning device 80. Also, in this cleaning processing, an absolute value of bias applied to the cleaning roller 81 may be set greater during at least a portion of the cleaning period of time. By the setting of the bias, it is possible to recover toner remaining on the transfer belt 40 efficiently.

On the contrary, when, at step S105, it is determined that the secondary transfer roller 61 comes to an appropriate position, that is, the secondary transfer roller 61 and the transfer belt 40 are separated from each other, at step S102 again, the image forming device waits for printing to be initialized. In this embodiment, although it is determined whether or not the secondary transfer roller 61 comes to an appropriate position at step S105 as described above, the processing may be simplified by not performing the determination but performing the processing at steps S106 to S108 in all cases.

As described above, in this embodiment, when the secondary transfer roller 61 and the transfer belt 40 are stopped in the contact state, the secondary transfer roller 61 and the transfer belt 40 are separated from each other and the transfer belt 40 is cleaned. According to this configuration, it is possible to prevent the secondary transfer roller 61 from coming in continuous contact with the transfer belt 40 and prevent the secondary transfer roller 61 from being contaminated during cleaning of the transfer belt 40.

In addition, according to this embodiment, when the image forming device does not work, it is possible to prevent the secondary transfer roller 61 from coming in continuous contact with the transfer belt 40 and prevent the surfaces of the secondary transfer roller 61 and the transfer belt 40 from being worn out and deteriorated.

For example, if the liquid developer is attached to the secondary transfer nip between the secondary transfer roller 61 and the transfer belt 40 and left, the dried liquid developer is fixed to both of the secondary transfer roller 61 and the transfer belt 40, and thus there is a problem in that the surfaces thereof may be damaged when printing is initialized. However, according to this embodiment, it is possible to designate the state where the secondary transfer roller 61 and the transfer belt 40 are separated from each other as the stopped state and thus to protect the surfaces of them. Since the transfer belt 40 made of an elastic material receives a reduced contact load from the secondary transfer roller 61, prolonging of the lifespan of the transfer belt 40 can be achieved.

In this embodiment, since the secondary transfer roller 61 is first separated from and moved near to the transfer belt 40 after performing the position correction so as to come to an appropriate position, there is no rubbing and friction between the surfaces of the secondary transfer roller 61 and the transfer belt 40 and there is no load on the surfaces thereof. The secondary transfer roller 61 which has been moved near to the transfer belt 40 in the state of coming to an appropriate state can quickly prepare for start of subsequent printing, for example, in the state as shown in FIG. 6.

The separating processing (S106), the position correction processing (S107), and the moving-near processing (S108) for the secondary transfer roller 61 may be performed automatically or manually. When they are performed manually, a user may be prompted to perform a next operation using a notification means such as a display device or the like. Particularly, when the secondary transfer roller 61 rotates manually during the position correction processing, it is possible to perform the correction processing such that the secondary transfer roller 61 quickly comes to an appropriate position by notifying a user of coming to the appropriate position.

Figure 16:
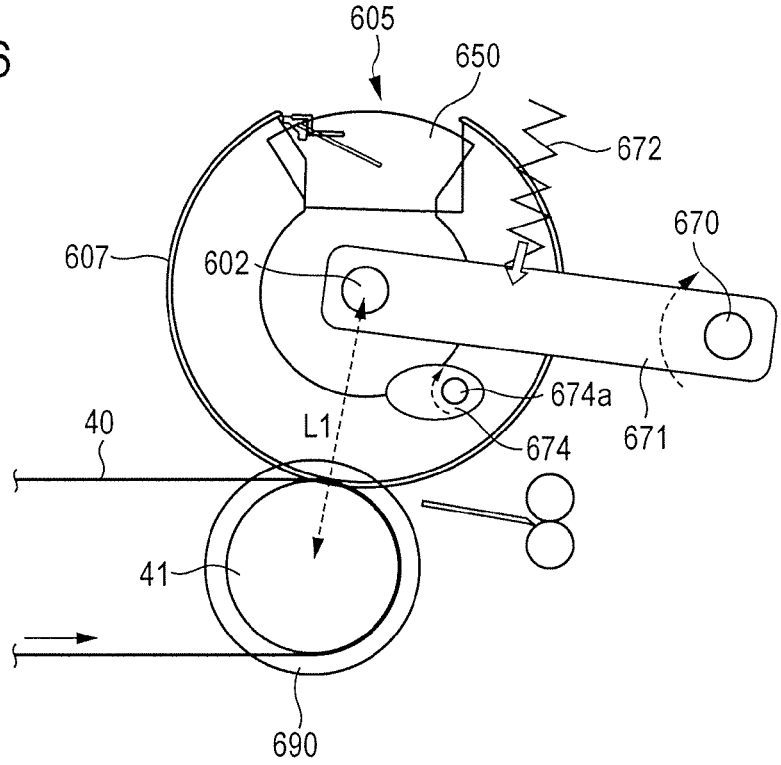
FIG. 16 is a diagram illustrating a state where the secondary transfer roller contacts with a transfer belt and stops.
Figure 18:
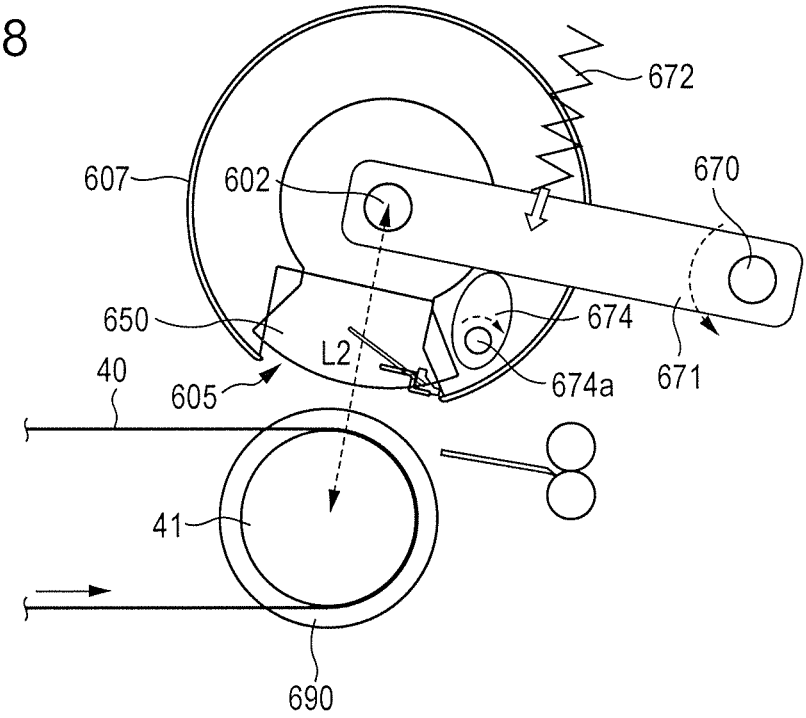
FIG. 18 is a diagram illustrating a state where a position of the secondary transfer roller is corrected.
Figure 19:
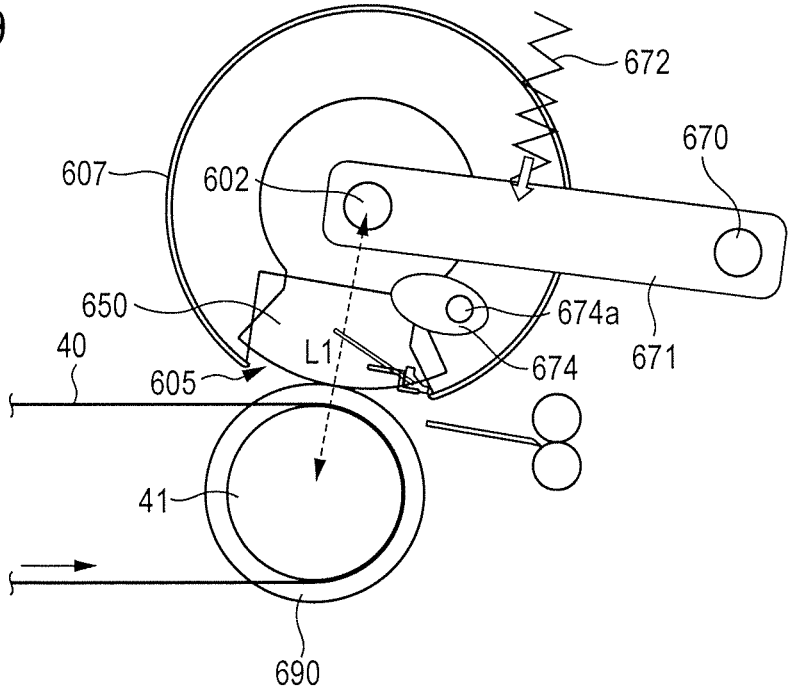
FIG. 19 is a diagram illustrating a state where the secondary transfer roller is moved toward the transfer belt.

A disjunction mechanism which separates the secondary transfer roller 61 from the transfer belt 40 and moves it near thereto will be described in detail with reference to FIGS. 16 to 19. FIG. 16 is a diagram illustrating a stopped state of the secondary transfer roller 61 in the state of contacting with the transfer belt 40, FIG. 17 is a diagram illustrating a state where the secondary transfer roller 61 is separated therefrom, FIG. 18 is a diagram illustrating a state where a position of the secondary transfer roller 61 is corrected, and FIG. 19 is a diagram illustrating a state where the secondary transfer roller 61 is moved near thereto.

As shown in FIG. 16, the disjunction mechanism of the secondary transfer roller 61 in this embodiment includes an inter-axis distance adjustment portion 674 which contacts and no contact with an end surface of the frame member 671 which supports the axis of the secondary transfer roller 61. The inter-axis distance adjustment portion 674 is a cam mechanism which is rotatable with respect to a rotation axis 674*a*, and can push up the frame member 671 depending on its rotation position. FIG. 16 shows a case where the secondary transfer roller 61 is stopped in the state of contacting with the transfer belt 40. The distance between axes of the secondary transfer roller 61 and the belt driving roller 41 where the transfer belt 40 is wound and hung is L1. In this case, the inter-axis distance adjustment portion 674 rotates with respect to the rotation axis 674*a* in the direction shown by the arrow, thereby pushing up the frame member 671. This corresponds to the separating processing (S106) of the secondary transfer roller 61 described with reference to FIG. 14.

Figure 17:
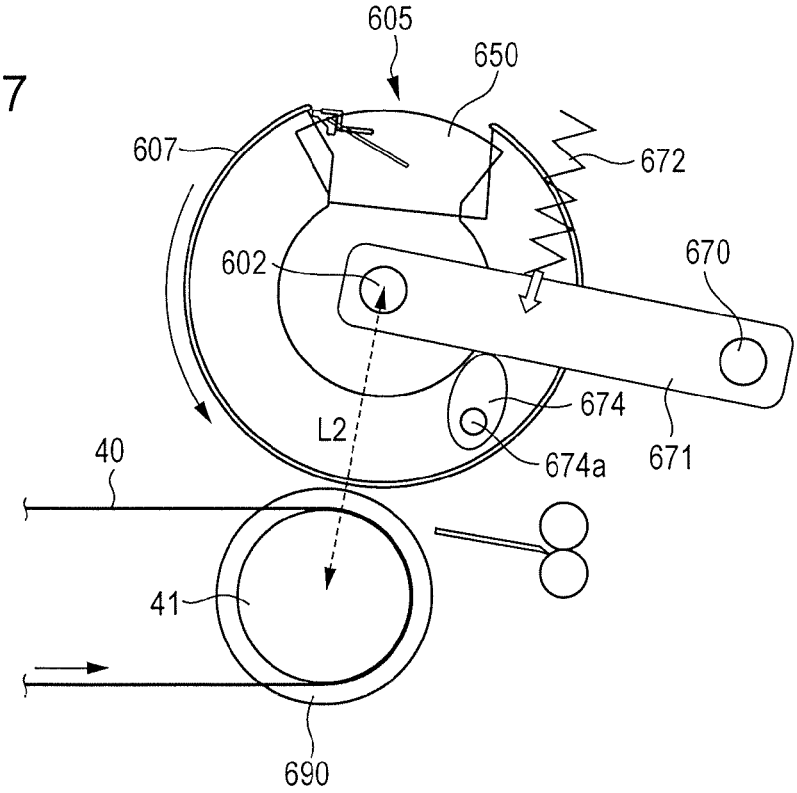
FIG. 17 is a diagram illustrating a state where the secondary transfer roller is separated from the transfer belt.

FIG. 17 shows a state where the secondary transfer roller 61 is separated from the transfer belt 40 by the inter-axis distance adjustment portion 674 pushing up the frame member 671. The distance between axes of the secondary transfer roller 61 and the belt driving roller 41 is changed from L1 in FIGS. 16 to L2 (L1<L2). In this separated state, the secondary transfer roller 61 rotates so as to come to an appropriate position. This corresponds to the position correction processing (S107) of the secondary transfer roller 61 described with reference to FIG. 14.

In this embodiment, the secondary transfer roller 61 rotates in the counterclockwise direction which is the opposite to the direction in a typical printing. By this rotation direction, it is possible to easily remove a transfer material when the transfer material is jammed. Particularly, when the secondary transfer roller 61 is stopped in the state where the transfer material gripper 610 grips a transfer material, since the transfer material can be released by the reverse rotation of the secondary transfer roller 61, the transfer material is easily removed.

FIG. 18 is a diagram illustrating a state after the position correction processing is performed such that the secondary transfer roller 61 comes to an appropriate position. The concaved portion 605 of the secondary transfer roller 61 faces the belt driving roller 41. The inter-axis distance adjustment portion 674 rotates again in the direction shown by the arrow from this state such that the secondary transfer roller 61 is moved near to the transfer belt 40. This corresponds to the moving-near processing (S108) of the secondary transfer roller 61 described with reference to FIG. 14.

FIG. 19 is a diagram illustrating a state after the secondary transfer roller 61 is moved near to the transfer belt 40, and, as shown in the figure, the elastic member 607 of the secondary transfer roller 61 is separated from the transfer belt 40. The distance between axes of the secondary transfer roller 61 and the transfer belt 40 is L1 originally shown in FIG. 16, and it is possible to quickly deal with starting of subsequent printing.

As described above, according to this embodiment, it is possible to reliably space the secondary transfer roller 61 and the transfer belt 40 apart from each other and to protect the surfaces thereof. Also, it is possible to deal with starting of subsequent printing by moving the secondary transfer roller 61 near to the transfer belt 40. The disjunction mechanisms of the secondary transfer roller 61 is not limited to the inter-axis distance adjustment portion 674 which pushes up the frame member 671 but may employ any other type.

Figure 20:
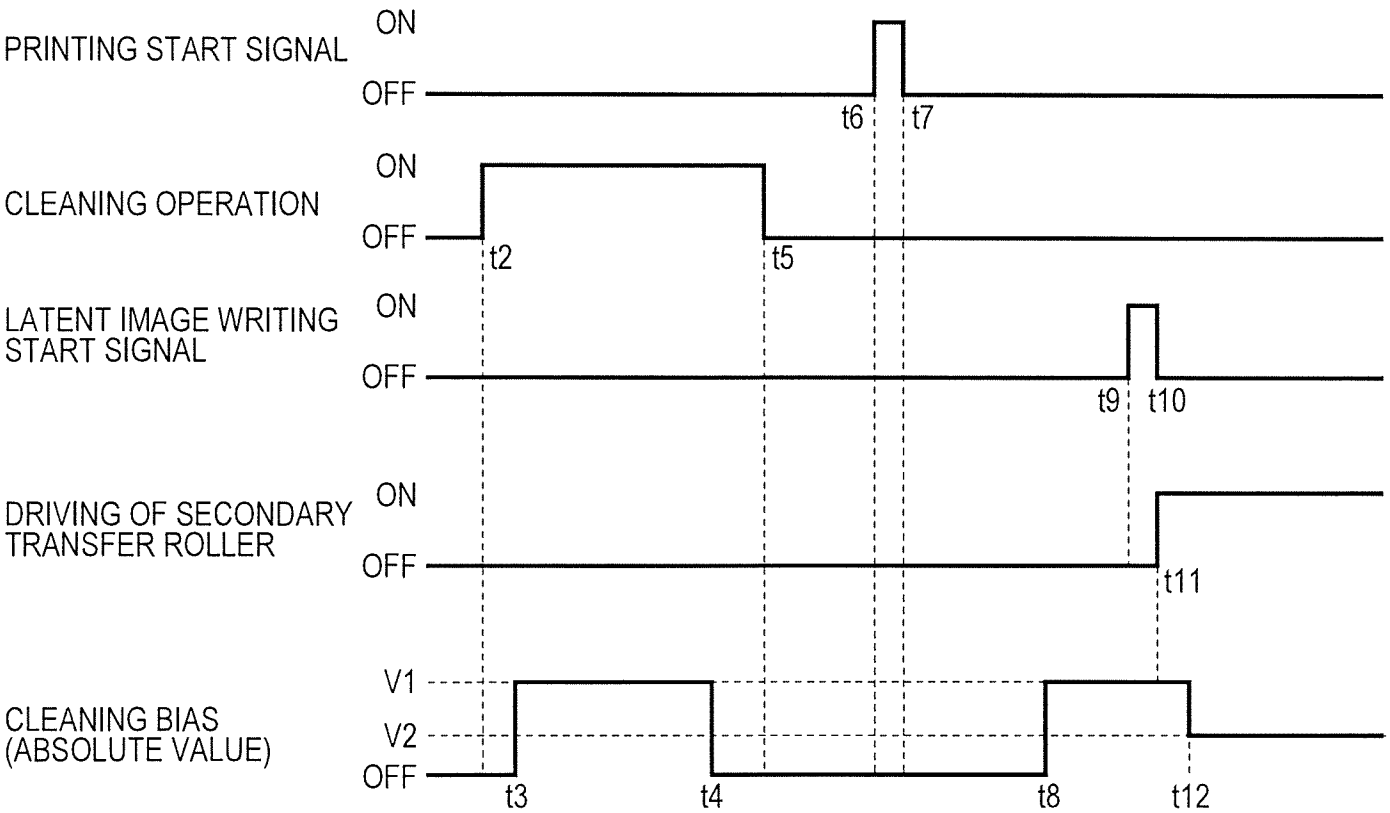
FIG. 20 is a diagram illustrating cleaning and printing start sequence.

FIG. 20 is a diagram illustrating cleaning and printing start sequence according to an embodiment of the invention. The sequence corresponds to the processing having influence on the steps S109 to S102 in the flowchart described with reference to FIG. 14.

For the times t2 to t5, the transfer belt 40 is cleaned during the rotation of the transfer belt 40. At this duration, the absolute value of the bias applied to the cleaning roller 81 from the bias application portion 86 is set to V1. The absolute value V1 of the bias is set greater than the absolute value V2 of the bias in a typical printing. By this setting of the bias, it is possible to improve recovery efficiency of toner remaining on the transfer belt 40. Since the transfer belt 40 and the secondary transfer roller 61 are separated from each other during the cleaning period, the secondary transfer roller 61 is not contaminated with toner images on the transfer belt 40.

After the cleaning operation is completed, when a printing start signal is input (time t6), first, the transfer belt 40 and the photoconductors 10Y, 10M, 100, and 10K begin to be driven and prepare the printing. At this step, the writing of latent images on the photoconductors 10 Y, 10M, 10C, and 10K by the exposure unit 12Y, 12M, 12C, and 12K and the rotation driving of the secondary transfer roller 61 do not begin. In this embodiment, in this state, the absolute value of the bias applied to the cleaning roller 81 is again set to V1 (a period between the time t8 to the time t12), and the cleaning device 80 removes toner remaining on the transfer nips formed between the transfer belt 40 and the photoconductors 10Y, 10M, 10C, and 10K.

Next, a signal instructing to start writing a latent image on the photoconductors 10Y, 10M, 10C, and 10K by the exposure units 12Y, 12M, 12C, and 12K is generated at the time t9. The time t9 is a timing where toner remaining between the transfer belt 40 and the photoconductors 10Y, 10M, 10C, and 10K do not have influence on the printing. After the generation of the latent image writing signal, the driving of the secondary transfer roller 61 begins at the time t11. As described above, in this embodiment, since the secondary transfer roller 61 rotates after the latent image is written in the photoconductors 10Y, 10M, 10C, and 10K, it is possible to reduce the probability that the secondary transfer roller 61 contacts with the transfer belt 40 before images are transferred to a transfer material, and thus to suppress the contamination of the secondary transfer roller 61.

Figure 21:
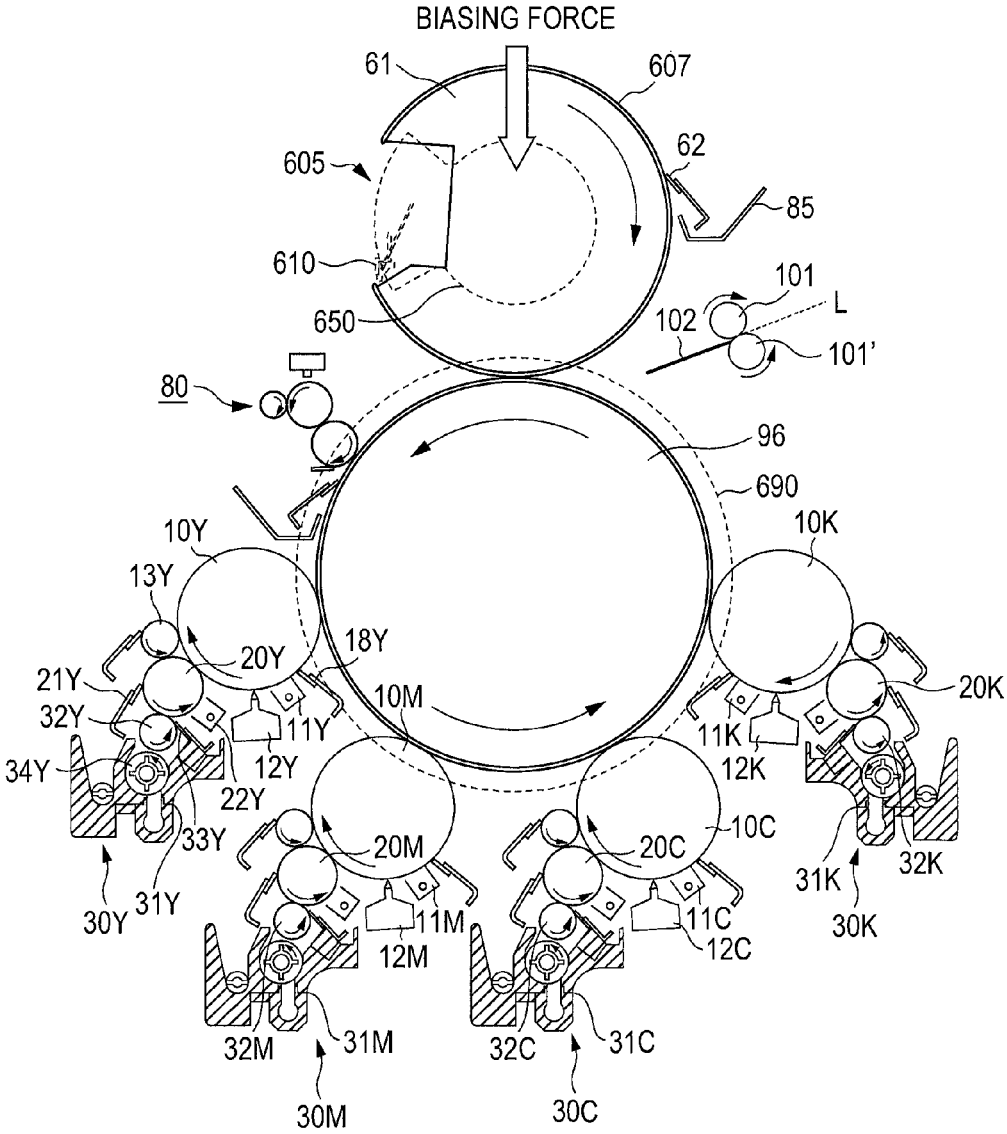
FIG. 21 is a diagram illustrating a main configuration of an image forming device according to another embodiment.

Next, another embodiment of the invention will be described. FIG. 21 is a diagram illustrating main constituent elements constituting an image forming device according to another embodiment of the invention. The elements the same as those in the previous embodiment are given the same reference numerals and thus the detailed description thereof will be omitted. The previous embodiment employs the transfer belt 40 as an image carrier, whereas this embodiment employs a transfer roller 96 (an "image carrier" drum in the embodiment of the invention) as an image carrier, which are different from each other. Also, in the transfer roller 96, the cleaning device 80 similar to that cleaning the transfer belt 40 in the previous embodiment is installed downstream of the secondary transfer nip.

On the transfer roller 96, toner images of yellow Y, magenta M, cyan C, and black K are formed by the development devices 30Y, 30M, 30C and 30K. The secondary transfer roller 61 is biased to the transfer roller 96 side by a mechanism (not shown), and thereby a predetermined pressure can be applied to the nip portion between the transfer roller 96 and the secondary transfer roller 61. In addition, although not shown, the secondary transfer roller 61 may be also provided with a disjunction mechanism the same as in the previous embodiment, and therefore it is possible to prevent the transfer roller 96 from being cleaned in the state where the secondary transfer roller 61 and the transfer roller 96 contact with each other.

In the same manner as the previous embodiment, each of the end portions of the secondary transfer roller 61 is provided with the contact member 650, and each of the end portions of the transfer roller 96 is provided with the support member 690. When the concaved portion 605 of the secondary transfer roller 61 faces the transfer roller 96 side, that is, when the circumference of the secondary transfer roller 61 is separated from the transfer roller 96, the contact member 650 contacts with the support member 690, and thereby it is possible to maintain a positional relationship between the secondary transfer roller 61 and the transfer roller 96.

In the embodiment employing the roller (transfer roller 96) as a transfer member as well, it can be easily inferred that the same effect as the embodiment employing the transfer belt 40 described previously can be achieved.

Although various embodiments have been described in this specification, embodiments constituted by properly combining the configurations in the respective embodiments also lie within the scope of the invention.

The entire disclosure of Japanese Patent Application No: 2009-259123, filed Nov. 12, 2009 is expressly incorporated by reference herein.

What is claimed is:

1. An image forming method comprising:

transferring an image carried by an image carrier to a transfer material by a transfer roller that contacts with the image carrier via the transfer material, that has a concaved portion in a circumferential surface and that contacts with or separates from the image carrier by a rotation;

separating the transfer roller from the image carrier by the rotation of the transfer roller after transferring the image to the transfer material;

stopping the transfer roller in a state where the transfer roller is separated from the image carrier; and moving the image carrier and cleaning the image carrier using a cleaning member while the transfer roller is stopped.

2. The image forming method according to claim 1, further comprising:

forming a latent image on a latent image carrier that transfers the image to the image carrier after cleaning the image carrier; and rotating the transfer roller after beginning to form the latent image on the latent image carrier.

3. The image forming method according to claim 1, wherein the image carrier is an image carrier belt wound on a roller.

4. An image forming device comprising:

an image carrier that carries an image;

a transfer roller that has a concaved portion in a circumferential surface and contacts with or separates from the image carrier by a rotation;

a cleaning member that cleans the image carrier; and a controller that enables the transfer roller to be stopped at a position where the transfer roller is separated from the image carrier by the rotation of the transfer roller, enables the image carrier to be moved when the transfer roller stops rotating, and enables the image carrier to be cleaned using the cleaning member.

5. The image forming device according to claim 4, further comprising a rotation position detector that detects a rotation position of the transfer roller, wherein the controller enables the transfer roller to stop rotating based on a result detected by the rotation position detector.

6. The image forming device according to claim 4, wherein the cleaning member comprises:

a cleaning roller that contacts with the image carrier and is applied with bias; and a coating member that coats liquid to the cleaning roller.

7. The image forming device according to claim 4, further comprising a gripper that grips a transfer material in the concaved portion.

* * * * *